US007090418B2

(12) United States Patent
Miki et al.

(10) Patent No.: US 7,090,418 B2
(45) Date of Patent: Aug. 15, 2006

(54) TAPE PRINTING APPARATUS HAVING A TAPE DISCHARGE MECHANISM AND METHOD OF DISCHARGING A TAPE

(75) Inventors: Takashi Miki, Nagoya (JP); Satoru Moriyama, Iwakura (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 2 days.

(21) Appl. No.: 10/898,217

(22) Filed: Jul. 26, 2004

(65) Prior Publication Data

US 2005/0031397 A1 Feb. 10, 2005

(30) Foreign Application Priority Data

Aug. 5, 2003 (JP) ..... 2003-286611

(51) Int. Cl.
*B41J 11/70* (2006.01)
*B26D 7/18* (2006.01)

(52) U.S. Cl. ..... 400/621; 83/112

(58) Field of Classification Search ..... None
See application file for complete search history.

(56) References Cited

U.S. PATENT DOCUMENTS 4,815,871 A * 3/1989 McGourty et al. ..... 400/120.16
2002/0094222 A1* 7/2002 Furuya et al. ..... 400/615.2

FOREIGN PATENT DOCUMENTS

JP 09300760 A * 11/1997
JP 2000071523 A * 3/2000
JP A 2000-71523 3/2000

* cited by examiner

*Primary Examiner*—Daniel J. Colilla
(74) *Attorney, Agent, or Firm*—Oliff & Berridge, PLC

(57) ABSTRACT

A tape printing apparatus including an internal unit having a print mechanism, a cutting mechanism, and a tape discharge mechanism that safely and reliably discharges tapes at a suitable speed to a proximate location relative to an apparatus main body. When printing a tape accommodated in a tape cassette by a thermal head, cutting the tape using a fixed blade and a movable blade and forcibly discharging the tape by a driving roller and a pressing roller, a bisectrix that bisects the width of the tape in a vertical direction is located further upward by a length L2 than a bisectrix of the driving roller and the pressing roller. As a result, the cut end of the tape will be rotated and gradually directed upward in the course of delivery of the tape by the driving roller and the pressing roller to discharge the tape outside of the apparatus main body through the tape discharge slot in a obliquely maintained position.

22 Claims, 22 Drawing Sheets

TAPE PRINTING APPARATUS HAVING A TAPE DISCHARGE MECHANISM AND METHOD OF DISCHARGING A TAPE

BACKGROUND OF THE INVENTION

1. Field of Invention

The invention relates to a tape printing apparatus that discharges printed tapes by using a tape discharge roller, and more particularly to a tape printing apparatus capable of reliably and safely discharging tapes from a tape discharge slot by positioning the tapes to be discharged in a shifted manner with respect to the tape discharge roller.

2. Description of Related Art

In the related art, there are tape printing apparatuses that accommodate a tape cassette containing a tape, printed characters such as letters and the like on the tape by using, for example, a thermal head or the like as pulling the printed tape out from the tape cassette.

For example, Japanese Patent Application Laid-Open Publication No. 2000-71523 discloses a tape printing apparatus that includes a cutting mechanism that cuts a printed tape and forcibly discharges the cut tape from a tape discharge slot by using a discharge mechanism portion. By discharging the cut tape, that the tape discharge slot will not be blocked by the cut tapes in a case of successive printing and cutting operations. Thus, the tape printing apparatus is capable of securing favorable printing and cutting operations.

In this tape printing apparatus, a fixed roller and a movable roller face a discharging position of the tape. When a pressing force exerted by the movable roller on the fixed roller is released by a certain extent, a biasing force of a biasing spring that is inserted in a shaft portion of a roller supporting member is instantaneously released so that a hook member moves in a direction that separates the hook member from the fixed roller and maintains an abutting condition between the movable roller and the fixed roller. With this movement, a hooking portion of the hook member hooks to one end of a second projecting portion to rotate the second projecting portion in a counterclockwise direction. As a result, a main body of the movable roller is rotated in a discharging direction of the tape to forcibly discharge the tape from the tape discharge slot.

SUMMARY OF THE INVENTION

However, the tape printing apparatus described above forcibly discharges a cut tape by pressing the movable roller through action of the biasing spring and by energetically rotating the movable roller in a counterclockwise direction. Therefore, the cut tapes may be discharged outside of the tape printing apparatus in an excessively accelerated condition and discharged far away from the tape discharge slot causing the cut tapes to become lost. Also, the tapes may become damaged when the tapes smash against an installation surface of the tape printing apparatus during the discharging operation.

One object of the invention is to provide a tape printing apparatus which prevents lost tapes by making tapes that have been cut by a cutting device and discharged, at a suitable speed through a tape discharge slot to drop in a proximate location relative to the tape printing apparatus, so the tapes can be reliably discharged without damage to the tapes due to shock caused by the tape dropping.

To achieve the above and/or other objects, according to one aspect of the invention, there is provided a tape printing apparatus having a cassette accommodating section that accommodates a tape cassette incorporating therein a tape, a print head that performs printing on the tape that has been drawn out from the tape cassette, a cutting device that cuts the tape that has been printed by the print head, a tape discharge slot through which the tape is discharged, and a discharge roller that discharges the tape, that has been cut by the cutting device, through the tape discharge slot, wherein the discharge roller is disposed such that a bisectrix that bisects a width of the tape and a bisectrix that bisects a roller width of the discharge roller are shifted from each other.

Because the discharge roller is disposed such that the bisectrix that bisects the width of the tape is shifted from the bisectrix that bisects the roller width of the discharge roller, a rotational force is generated in the tape, which has been printed by the print head and that is discharged from the tape discharge slot by the discharge roller, when the tape is delivered by the discharge roller. Thus, the tape is discharged from the discharge slot in a rotating condition. Accordingly, the tape may be discharged at a suitable speed, from the apparatus as dropping at the same proximate location relative to the tape printing apparatus. As the tape is not ejected far away from the tape discharge slot, it is possible to prevent the tape from getting lost and prevent damage to the tape resulting from shock caused by the tape dropping. Further, when a tape having a narrow tape width is used, the entire surface of the tape is not pressed by the discharge roller. As a result, the tape can be reliably discharged from the tape discharge slot without the tape adhering to the discharge roller so as to prevent discharge thereof.

BRIEF DESCRIPTION OF THE DRAWINGS

Objects, features and advantages of the invention will become more apparent from reading the following description of exemplary embodiments taken in connection with the accompanying drawings in which.

DETAILED DESCRIPTION OF EXEMPLARY EMBODIMENTS

Figure 1:
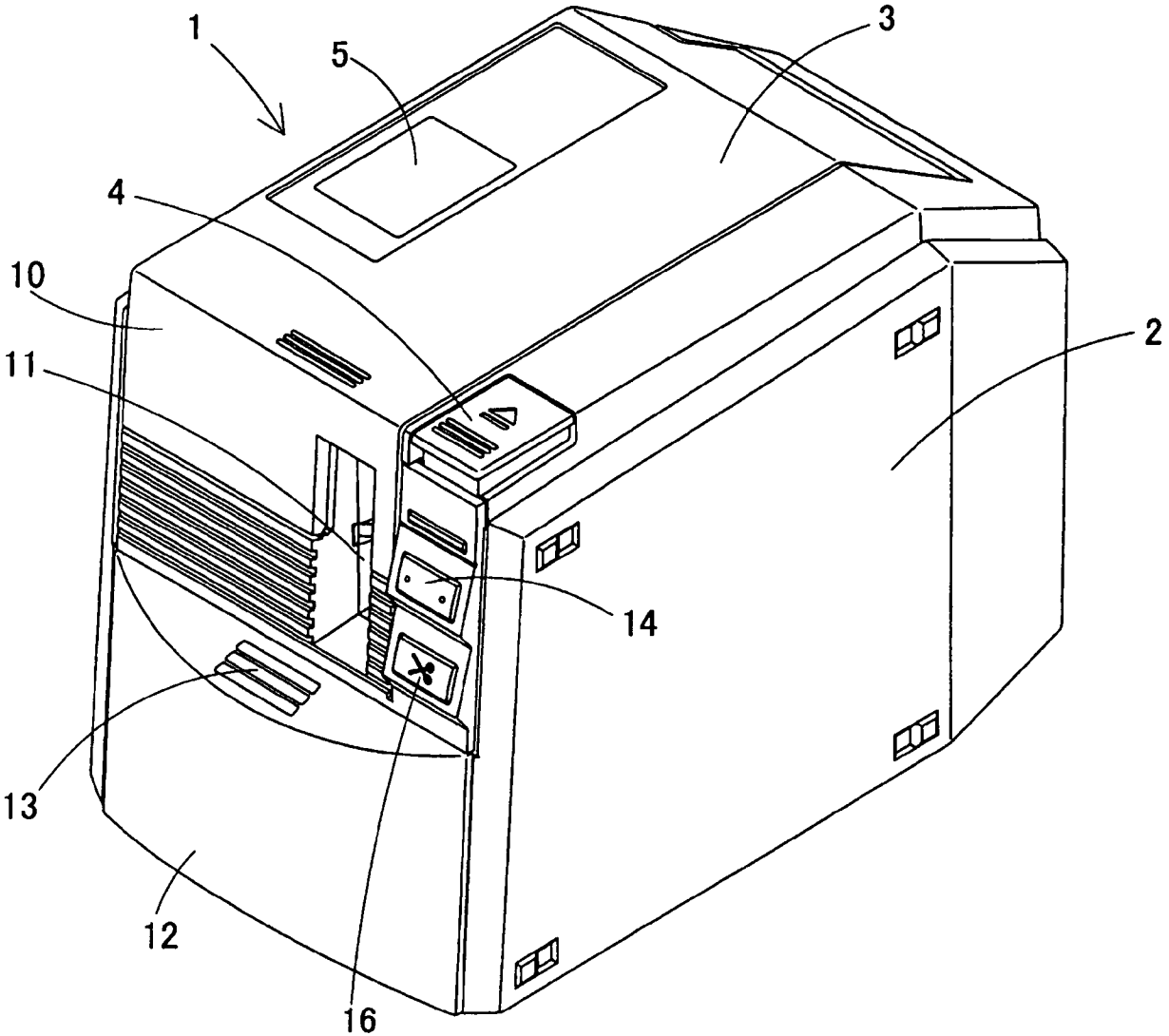
FIG. 1 is a schematic perspective view of the tape printing apparatus of an exemplary embodiment of the invention.

Exemplary embodiments of the tape printing apparatus of the invention will be described in detail with reference to the accompanying drawings. First, a schematic structure of the tape printing apparatus of this embodiment will first be described with reference to FIG. 1. FIG. 1 is a perspective view of the tape printing apparatus.

As shown in FIG. 1, the tape printing apparatus 1 is connected to a personal computer (not shown, and hereinafter referred to as PC) and creates tapes being printed with desired characters, letters or the like on the tapes on the basis of printing instructions received from the PC. The tape printing apparatus 1 includes an apparatus main body 2 and a lid 3. The apparatus main body 2 includes a topmost surface and a bottommost surface that rests on a drop surface 86 (see FIG. 14). The lid 3 is provided at the topmost surface and axially supported in a rotating manner at a right end portion of the apparatus main body 2 to allow the lid 3 to open and close. Further, the lid 3 is continuously biased in a releasing direction by a biasing member such as a spring. When a lid open button 4 that is disposed at a side portion of the top surface of the apparatus main body 2 is pressed, a locked condition between the lid 3 and the apparatus main body 2 is released through the action of the biasing member.

A see-through window 5 covered by a transparent cover is formed at a portion located off-centered from a central portion of the lid 3, wherein the see-through window 5 corresponds to a tape identifying and displaying portion 8 (see FIG. 3) provided on a top surface of a tape cassette 7 that is mounted to a cassette accommodating section 6 disposed within the apparatus main body 2. More particularly, as illustrated in FIG. 1, when the tape cassette 7 is mounted to the cassette accommodating section 6 and the lid 3 is closed, the see-through window 5 and the tape identifying and displaying portion 8 of the tape cassette 7 will align and face each other so that the tape identifying and displaying portion 8 can be viewed through the transparent cover of the see-through window 5 from the exterior of the apparatus main body 2. Here, the tape identifying and displaying portion 8 may indicate, for instance, a tape width or a tape color of a tape 9 that is stored in the tape cassette 7. With this structure, a type of the tape cassette 7 that is mounted to the cassette accommodating section 6 can be easily viewed through the see-through window 5 from the exterior of the apparatus main body 2.

Figure 15:
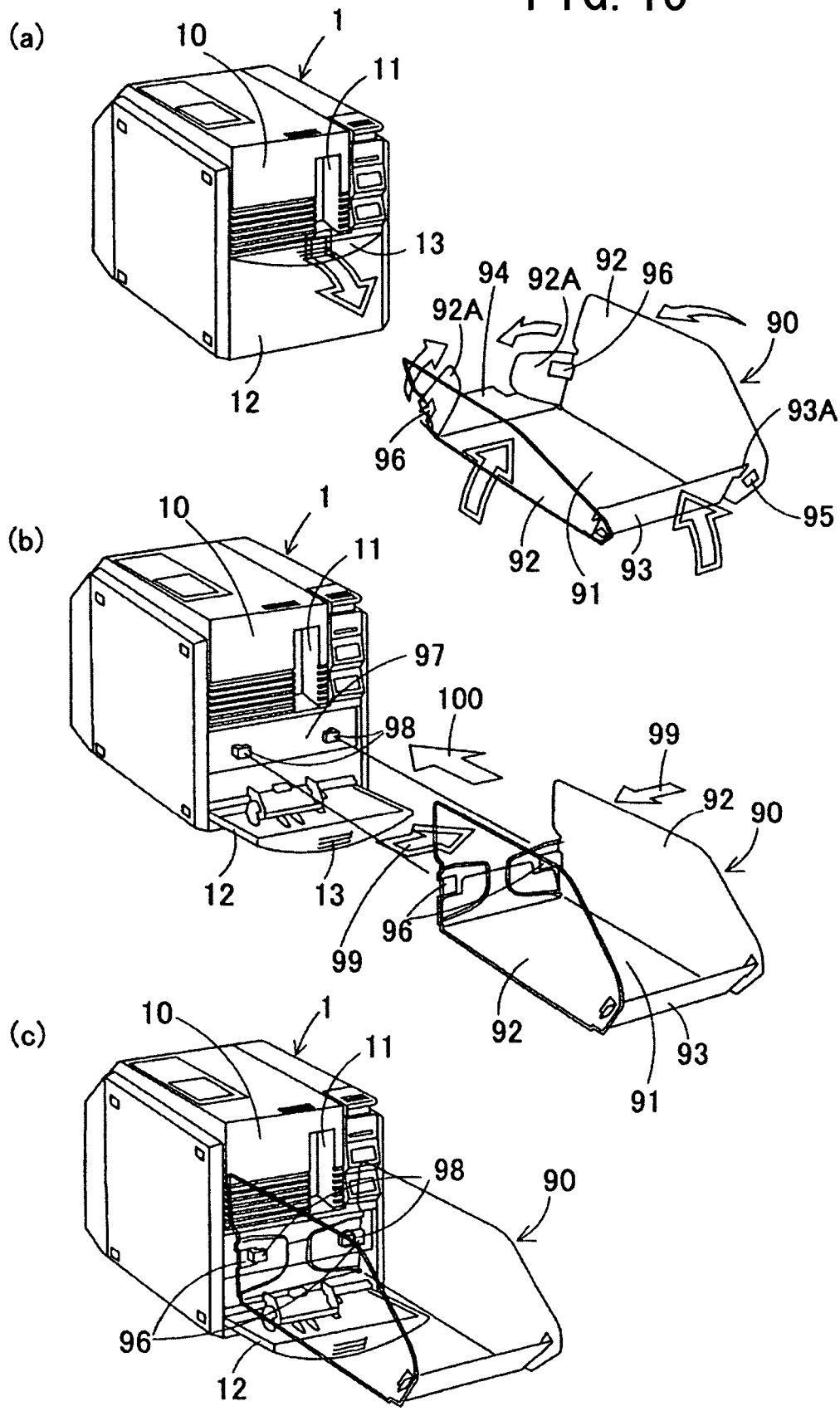
FIG. 15*a* is a perspective view of the tape printing apparatus of FIG. 1 and a tray prior to mounting.
FIG. 15*b* is a perspective view of the tape printing apparatus of FIG. 1 and the tray during mounting.
FIG. 15*c* is a perspective view of the tape printing apparatus of FIG. 1 and the tray after mounting.

The apparatus main body 2 includes a sidewall 10 on a front side (left-hand side in FIG. 1). A tape discharge slot 11, through which the tape 9 that has been printed within the apparatus main body 2 is discharged to the exterior, is formed at the sidewall 10. A side lid 12 is also provided downward of the tape discharge slot 11 at the sidewall 10. The side lid 12 has a lower end that is supported in a rotatable manner. By pressing a pressing portion 13 located at an upper end of the side lid 12, the side lid 12 is forwardly released (see FIG. 15). By releasing the side lid 12 and mounting a tray 90 to the front side of the apparatus main body 2, the tape 9 that has been discharged from the tape discharge slot 11 can be received in the tray 90. Details will be described later.

At the sidewall 10 of the apparatus main body 2, a power button 14 that switches the power of the tape printing apparatus 1 ON and OFF is provided downward of the lid open button 4, and a cutter driving button 16, through which a cutting mechanism 15 (see FIG. 7) provided within the apparatus main body 2 is driven through manual operations by a user, is provided downward of the power button 14. Here, the cutter driving button 16 is a button that is pressed when the tape 9 is to be cut to a desired length through manual operations. The cutting mechanism 15 that is provided in the tape printing apparatus 1 will be described later.

Next, an internal structure of the tape printing apparatus 1 will be described with reference to FIGS. 2 to 8.

As shown in FIGS. 2 to 8 an internal unit 20 includes the cassette accommodating section 6 that accommodates the tape cassette 7, a print mechanism 21 that performs printing of the tape 9, the cutting mechanism 15 that cuts the tape 9 that has been printed by the print mechanism 21, and a tape discharge mechanism 22 that forcibly discharges the tape 9 that has been cut by the cutting mechanism 15 through the tape discharge slot 11. As a result, the tape cassette 7 is accommodated in the cassette accommodating section 6 such that a direction of a width direction of the tape 9 that is discharged from the tape discharge slot 11 is positioned in a vertical direction.

Figure 2:
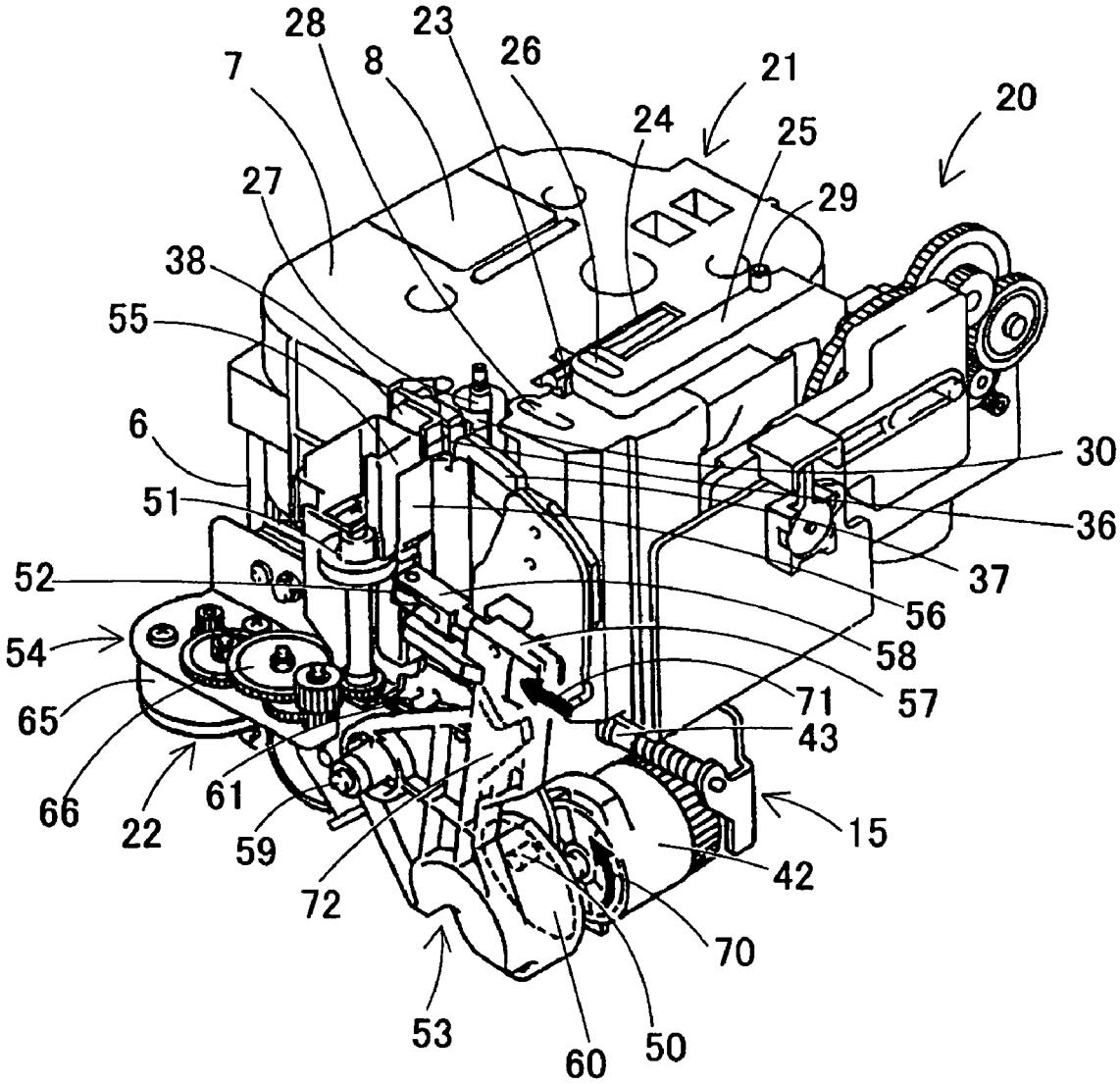
FIG. 2 is a schematic perspective view of an internal unit of the tape printing apparatus according to the exemplary embodiment.

The print mechanism 21 that performs printing of the tape 9 will now be described with reference to FIGS. 2 and 3. FIG. 2 is a perspective view of the internal unit 20 located in the interior of the tape printing apparatus 1 according to the invention, and FIG. 3 is a plan view of the internal unit 20 of the tape printing apparatus 1 according to the invention.

Figure 3:
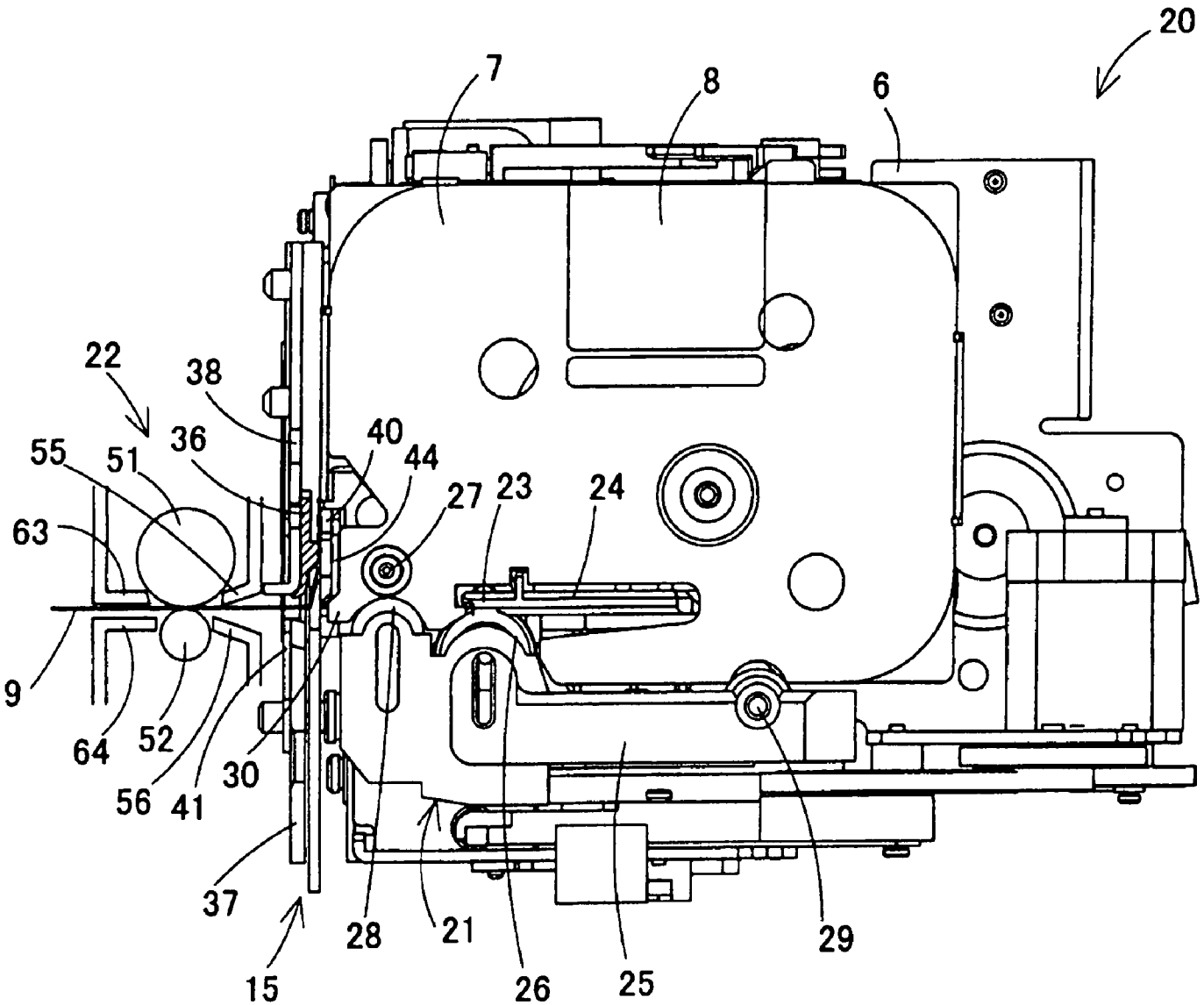
FIG. 3 is a sectional view of the internal unit of the tape printing apparatus according to the exemplary embodiment.

As shown in FIGS. 2 and 3, the print mechanism 21 includes a thermal head 23 disposed at a head mounting portion 24 that is provided in the cassette accommodating section 6, and a platen roller 26 that is supported by a roller holder 25 in a rotatable manner. The roller holder 25 is disposed to oppose the thermal head 23 at a position that creates a pressure-contact between the roller holder 25 and the thermal head 23. The thermal head 23 includes a plurality of heating elements and performs the printing of characters, letters or the like to the tape 9.

A tape feeding roller 27 is rotatably supported at a proximate location to a tape discharge portion 30 of the tape cassette 7, and a tape pressure roller 28 that is supported by the roller holder 25 in a rotatable manner is disposed to oppose the tape feeding roller 27 that creates a pressure-contact between the roller holder 25 and the tape feeding roller 27.

In the cassette accommodating section 6, the roller holder 25 is pivotally supported in a rotatable manner through a support shaft 29 in front of the tape cassette 7 (lower side in FIG. 3), and the roller holder 25 is arranged to be switchable between a printing position and a releasing position through a switch mechanism (FIG. 3 illustrates a condition in which the roller holder 25 is switched to the printing position).

The platen roller 26 and the tape pressure roller 28 are provided at the roller holder 25 allowing the platen roller 26 and the tape pressure roller 28 to rotate and press-contact against the thermal head 23 and the tape feeding roller 27 when the roller holder 25 is switched to the printing position. With this structure, the tape feeding roller 27 and the tape pressure roller 28 are rotated and driven in conjunction with each other by a tape feed motor and a gear mechanism (not shown). As a result, the tape 9 that is printed with characters, letters or the like by the thermal head 23 is discharged from the tape discharge portion 30 in the tape discharging direction (leftward direction in FIG. 3).

Next, the tape 9 that has been printed by the print mechanism 21 is cut by the cutting mechanism 15 either automatically or by manual operation of the cutter driving button 16, as will be described later. The tape 9 is then discharged through the tape discharge slot 11 formed at the sidewall 10 by the tape discharge mechanism 22.

Figure 4:
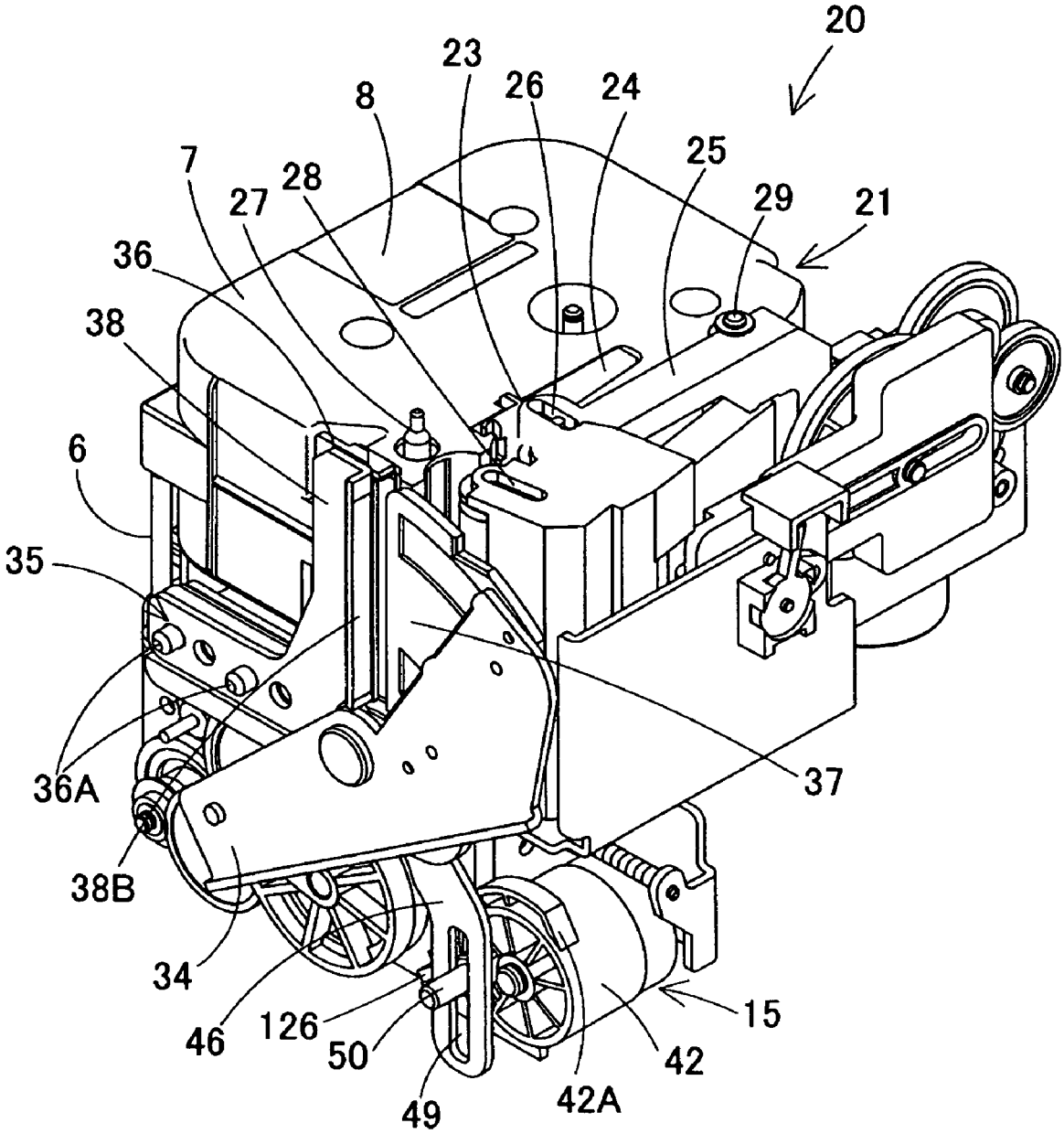
FIG. 4 is a perspective view of a condition in which a tape discharge mechanism of the internal unit of FIG. 3 is detached.
Figure 5:
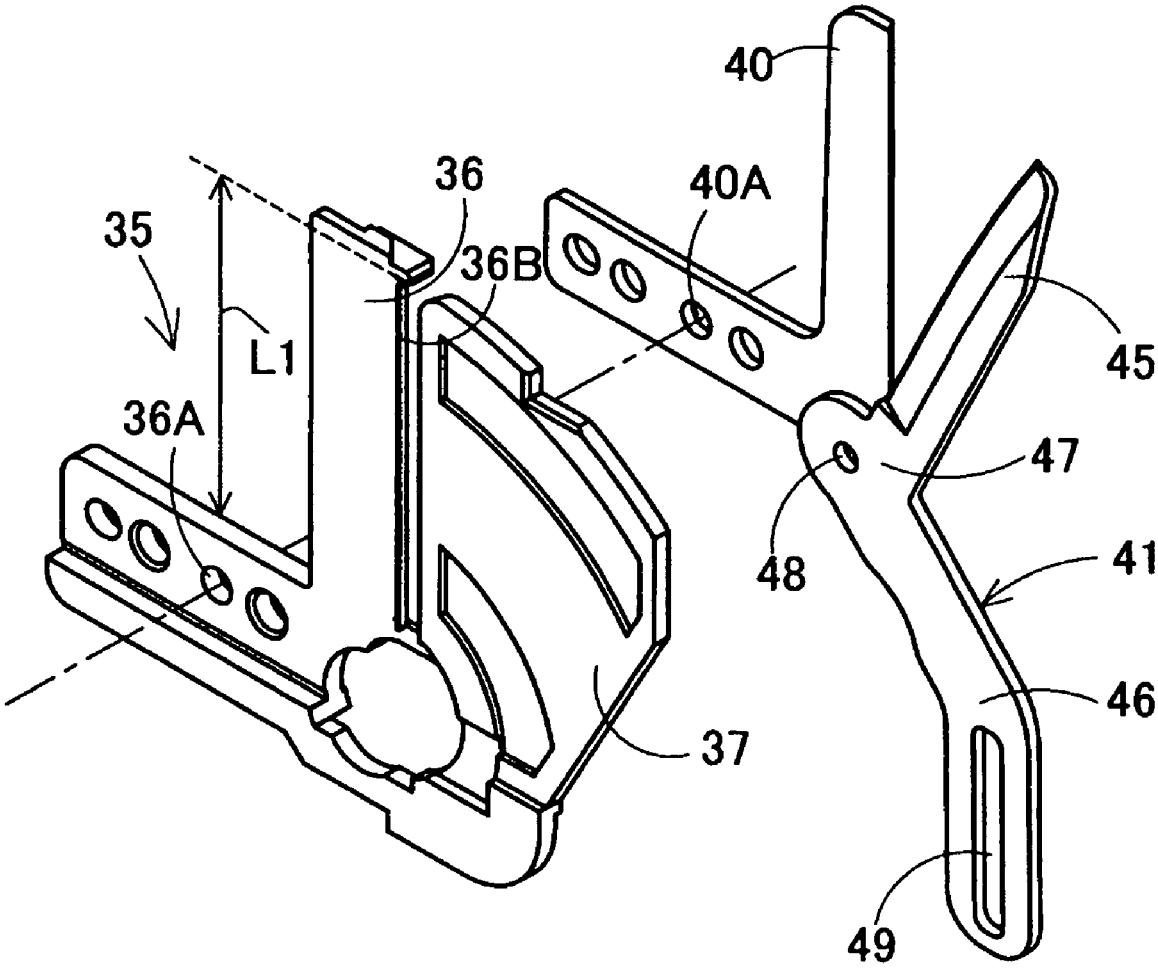
FIG. 5 is a perspective view of a fixed blade, a movable blade and a tape guide portion of the tape printing apparatus according to the exemplary embodiment.
Figure 6:
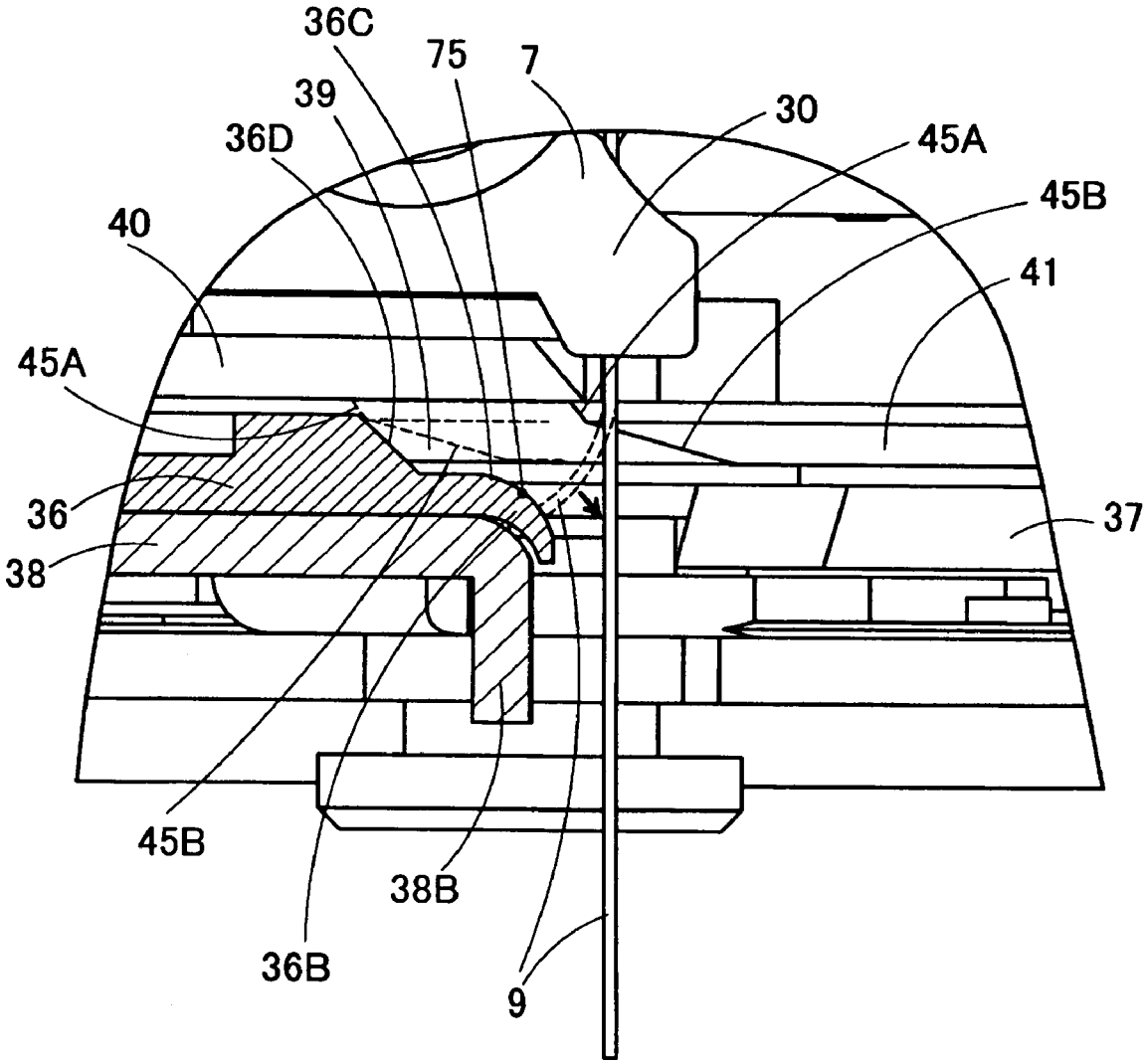
FIG. 6 is a sectional view of the fixed blade, the movable blade and the tape guide portion of the tape printing apparatus according to the exemplary embodiment.
Figure 7:
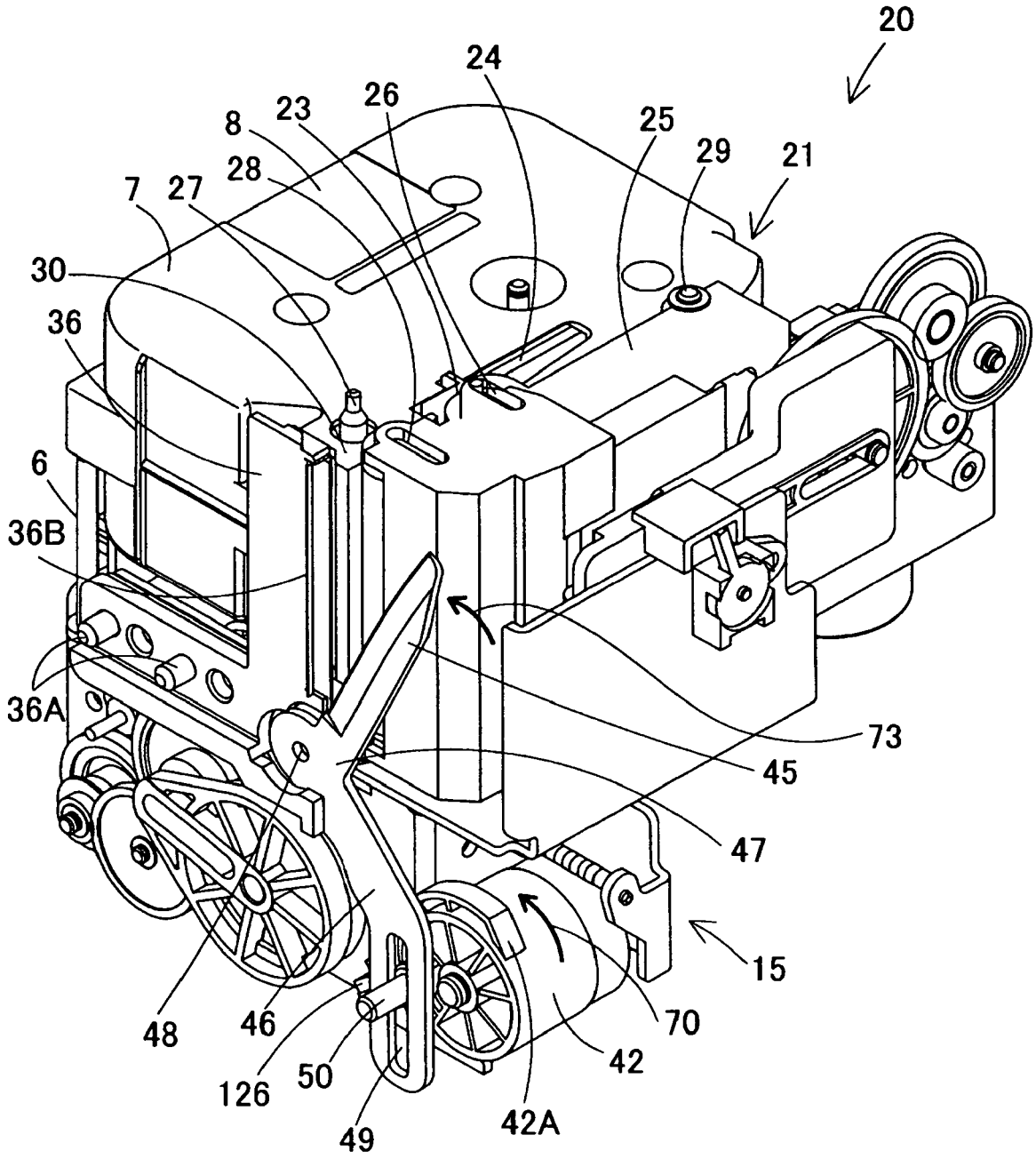
FIG. 7 is a perspective view of a cutting mechanism, of the tape printing apparatus of FIG. 1, in an initial condition.
Figure 8:
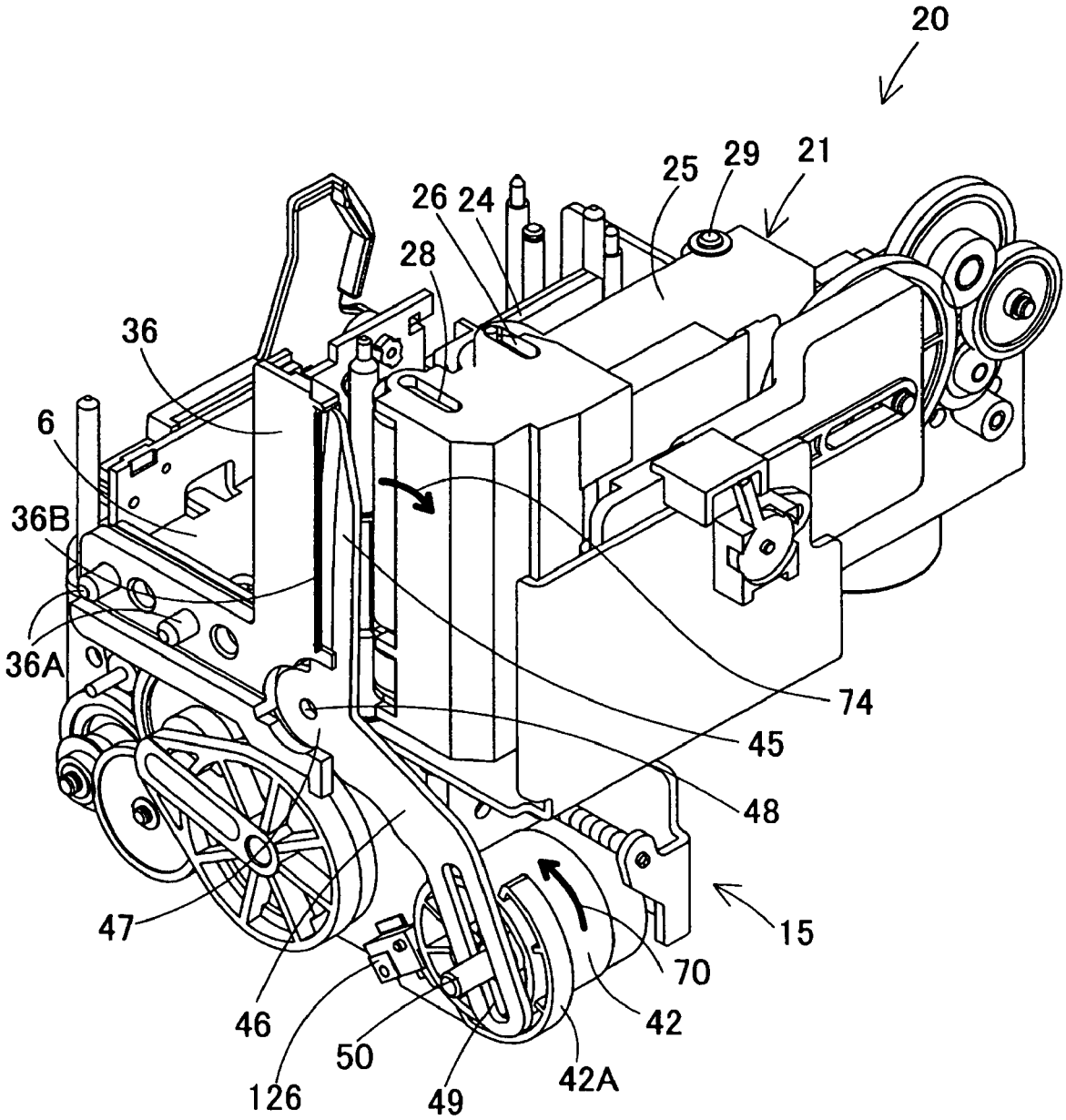
FIG. 8 is a perspective view illustrating a cutting mechanism, of the tape printing apparatus of FIG. 1, in a cutting condition.

The cutting mechanism 15 that cuts the tape 9 will be described with reference to FIGS. 2 to 8. FIG. 4 is a perspective view of the internal unit 20 in a condition in which the tape discharge mechanism 22 is detached. FIG. 5 is a perspective view of a movable blade 41, a fixed blade 40 and a tape guide portion according to the invention, and FIG. 6 is a sectional view of the movable blade 41, the fixed blade 40 and the tape guide portion according to the invention. Further, FIGS. 7 and 8 are perspective views of the internal unit 20 and the cutting mechanism 15.

As shown in FIGS. 2 to 6, the cutting mechanism 15 includes a fixed blade 40, a movable blade 41 that performs cutting operations together with the fixed blade 40, a cutter helical gear 42 that is connected to the movable blade 41, and a cutter motor 43 that is connected to the cutter helical gear 42 through a gear train. The fixed blade 40 is fixed to a side plate 44 that is provided in an upright condition on a left-hand side of the cassette accommodating section 6 within the cutting mechanism 15 through fixing holes 40A by fasteners such as screws or the like.

Figure 9:
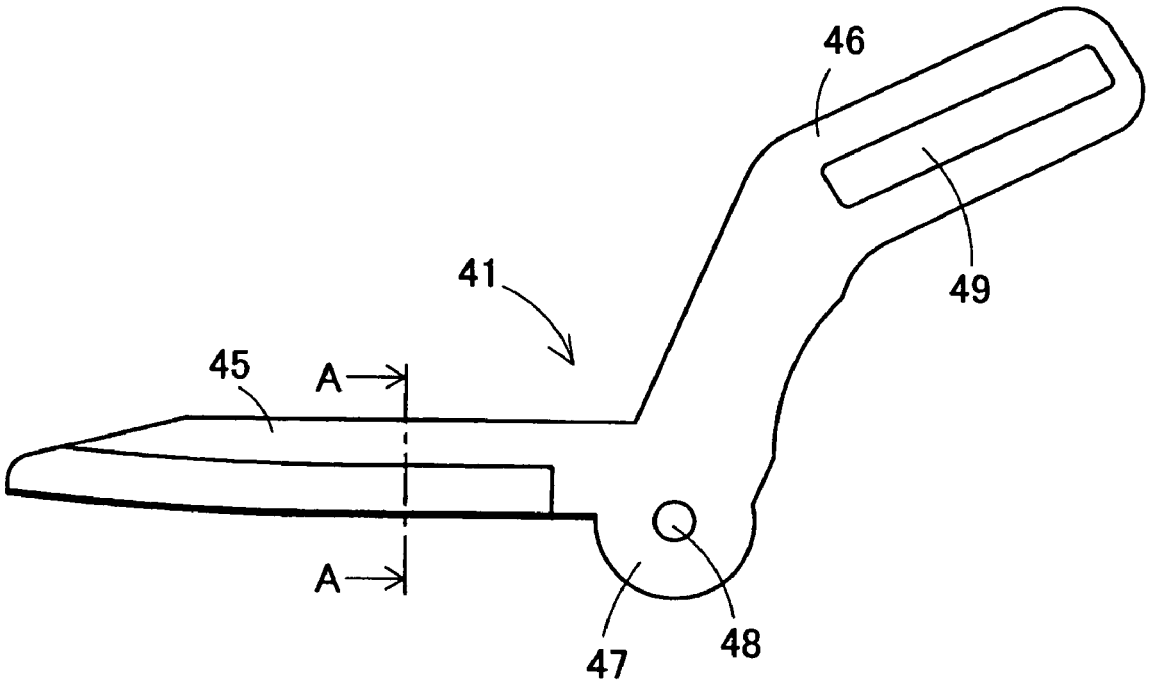
FIG. 9 is a plan view of the movable blade according to the exemplary embodiment shown in FIG. 5.
Figure 10:
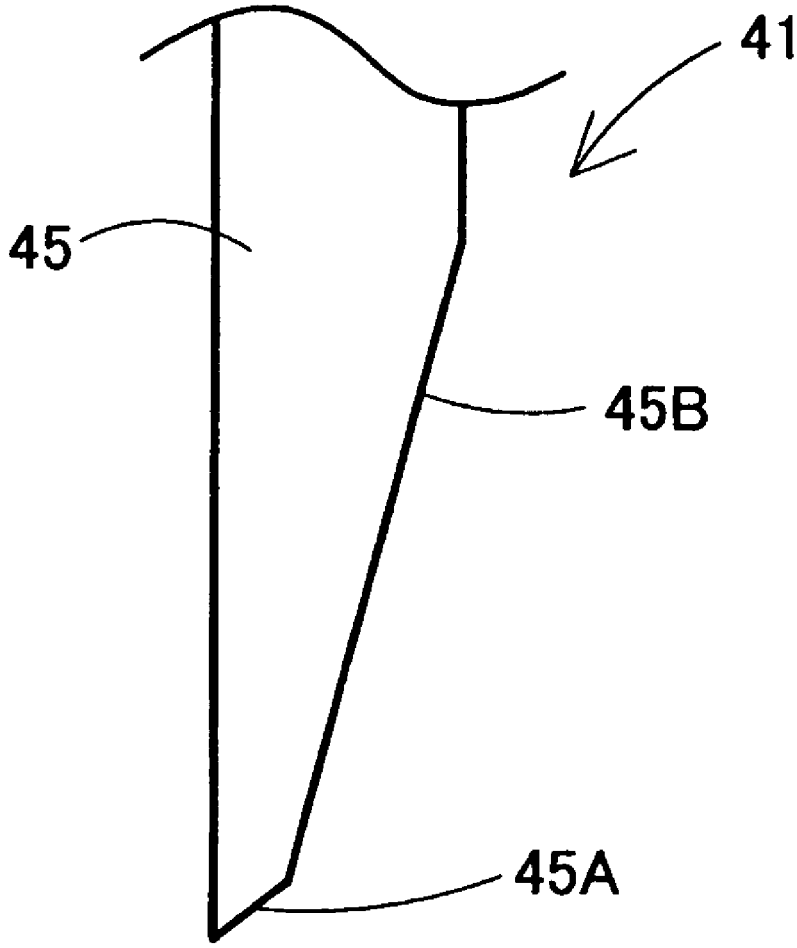
FIG. 10 is a sectional view of a blade part of the movable blade taken along line A—A in FIG. 9.

As shown in FIG. 9 and 10, the movable blade 41 is substantially V-shaped and includes a blade part 45 that is provided at a cutting portion of the tape 9 to be cut, a handle portion 46 that is located opposite of the blade part 45, and an angle part 47. FIG. 9 is a front view of the movable blade 41 according to the invention. FIG. 10 is a sectional view of the blade part 45 of the movable blade 41 taken along line A—A in FIG. 9.

An axis hole 48 is provided at the angle part 47, wherein the movable blade 41 is supported by an axis hole at the side plate 44 such that it may rotate with the angle part 47 having a fulcrum. An elongated hole 49 is formed in the handle portion 46 on the opposite side of the blade part 45 that is provided at a cutting portion of the movable blade 41.

The blade part 45 includes a rear surface attached to a two-stepped blade portion where a blade surface thereof is formed by two sloped surfaces having different inclination angles, namely a first sloped surface 45A and a second sloped surface 45B, causing the thickness of the blade part 45 to gradually thin (see FIG. 10). The first sloped surface 45A is arranged at an angle of about 50 degrees with respect to the rear surface of the blade part 45.

The cutter helical gear 42 includes a boss 50 arranged in a form of a protrusion that may be inserted into the elongated hole 49 of the movable blade 41 (see FIG. 7). With this structure, when the cutter helical gear 42 is rotated by the cutter motor 43, the movable blade 41 is swung through the boss 50 and the elongated hole 49 with the axis hole 48 being the fulcrum, and the tape 9 is accordingly cut.

A concrete cutting device for the tape 9 including the fixed blade 40 and the movable blade 41 will be described with reference to FIGS. 7 and 8.

In case where the boss 50 of the cutter helical gear 42 is located at an inside position (left-hand side in FIG. 7), the movable blade 41 is located at a remote position from the fixed blade 40 (this condition is hereinafter considered as an initial condition. See FIG. 7). When the cutter motor 43 starts rotating in this initial condition and the cutter helical gear 42 is rotated in a counterclockwise direction (direction of arrow 70), the boss 50 moves to an outside position, and the movable blade 41 rotates in the counterclockwise direction (direction of arrow 73) about the axis hole 48 to cut the tape 9 together with the fixed blade 40 that is fixed in the internal unit 20 (this condition is hereinafter considered as a cutting condition. See FIG. 8). After cutting the tape 9, the movable blade 41 is returned to the initial condition to cut the next tape 9 that is being delivered. The cutter motor 43 is repeatedly driven to rotate the cutter helical gear 42 in the counterclockwise direction (direction of arrow 70) to repeatedly move the boss 50 between the inside and outside positions as the movable blade 41 is rotated in a clockwise direction (direction of arrow 74) in order to separate the movable blade 41 from the fixed blade 40 (see FIG. 7). A condition in which the next tape 9 that has been printed and delivered from the tape cassette 7 can be cut in this manner.

A cutter helical gear cam 42A is provided on a cylindrical outer wall of the cutter helical gear 42. When the cutter helical gear 42 is rotated by the cutter motor 43, a micro switch 126 that is provided adjacent to the cutter helical gear 42 is switched from an OFF condition to an ON condition through the action of the cutter helical gear cam 42A. As a result, the cutting condition of the tape 9 can be detected.

As shown in FIGS. 4 and 5, the internal unit 20 also includes a half cut unit 35 on a downstream side of the fixed blade 40 and the movable blade 41 along the tape discharging direction. The half cut unit 35 is located between the fixed blade 40, the movable blade 41 and first guide walls 55, 56 (see FIG. 2).

The half cut unit 35 includes a fixed arm 38 that is disposed at a position corresponding to the fixed blade 40, a half cutter 34 that is disposed on the fixed blade 40 side to oppose the fixed arm 38, a first guide portion 36 that is disposed between the fixed blade 40 and the fixed arm 38 in accordance with the fixed blade 40, and a second guide portion 37 that is disposed to oppose the first guide portion 36 in accordance with the movable blade 41 (see FIGS. 4 and 5). The first guide portion 36 and the second guide portion 37 are uniformly formed and are mounted to the side plate 44 together with the fixed blade 40 by using a guide fixing portion 36A that is provided at a position corresponding to the fixing holes 40A of the fixed blade 40.

As shown in FIG. 6, the fixed arm 38 includes an end portion that opposes the tape 9 that is discharged from the tape discharge portion 30. The end portion is an anvil 38B that is bent to become parallel with respect to the tape 9. The tape 9 includes a base material onto which printing is performed, an adhesive layer and separator. By peeling off the separator, the tape 9 can adhere to a desired surface. When the half cutter 34 is pressed against the anvil 38B, the base material and the adhesive layer of the tape 9 that is located between the half cutter 34 and the anvil surface 38A will be cut as the separator remains uncut. The anvil 38B also serves to guide the tape 9 to the tape discharge slot 11 together with the first guide portions 55, 56.

An end portion 36B of the first guide portion 36 that opposes the tape 9 being discharged is arranged to project along the anvil 38B that is formed at the end portion of the fixed arm 38 and to be bent in a discharging direction of the tape 9. The end portion 36B of the first guide portion 36 includes a smooth curved surface, with respect to the discharging direction of the tape 9, at a contact surface 36C with respect to the tape 9 that is discharged from the tape cassette 7.

The tape 9 stored in the tape cassette 7 is wound around a shaft so that the tape is rolled up. When the tape 9 is delivered from the tape cassette 7 using a tape feed motor (not shown) in the above-explained manner, the tape 9 is curled in a specified direction (leftward direction in FIG. 6 in the exemplary embodiment) due to the tape 9 being rolled up. When a cut end of the curled tape 9 enters between the fixed blade 40 and the fixed arm 38 in the course of delivery, a problem may exist where the tape 9 may remain within the apparatus main body 2 without being discharged from the tape discharge slot 11 to the exterior.

By arranging the end portion 36B of the first guide portion 36 to project by forming the contact surface 36C as a curved surface, the cut end of the tape 9 that is curled, by not less than a specified curvature, will first abut the contact surface 36C of the first guide portion 36. When the cut end of the tape 9 has hit a portion that is located further downstream of the discharging direction of the tape 9 than a boundary point 75 on the contact surface 36C of the first guide portion 36 (lower direction in FIG. 6), the cut end of the tape 9 will move towards the downstream side along the curved surface so that the tape 9 will not enter between the fixed blade 40 and the first guide portion 36 or the fixed arm 38. Instead, the tape 9 will be lead to the direction of the tape discharge slot 11.

The position of the boundary point 75 of the contact surface 36C is determined based on a positional relationship between the tape discharge portion 30, the contact surface 36C and the curvature of curl of the tape 9 so that the cut end of the tape 9 always hits against a portion of the contact surface 36C that is located closer to the tape discharge slot 11 than the boundary 75. As a result, it is possible to reliably discharge the tape 9 from the tape discharge slot 11 without having the tape 9 remain in the interior of the apparatus main body 2. When the tapes 9 are successively discharged, it is also possible to prevent the tape 9 remaining in the apparatus main body from clogging the tape discharge slot 11 whereupon the following tapes are jammed in the tape discharge slot 11.

Because a guide width L1 (see FIG. 5) of the first guide portion 36 that corresponds to a delivery path of the tape 9 is larger than a maximum width of the tape 9 to be mounted (36 mm in the embodiment), the entire surface of the tape 9 can be induced along the curved surface formed at the contact surface 36C of the first guide portion 36. As a result, jamming of the tape 9 by getting stuck at an upper end or a lower end thereof is prevented.

An inner surface 36D is successively formed to extend from the contact surface 36C in the first guide portion 36. The inner surface 36D is formed to oppose the first and second sloped surfaces 45A, 45B of the movable blade 41. When performing cutting, a part of the first and second sloped surfaces 45A, 45B of the movable blade 41 will abut the tape 9 thereto (see FIG. 6).

Because the blade part 45 of the movable blade 41 is formed by a two-stepped blade as described above, when the tape 9 is cut by the movable blade 41, a clearance 39 will be formed between the contact surface 36C that corresponds to the end portion of the first guide portion 36 or the inner surface 36D and the second sloped surface 45B of the movable blade 41 (see FIG. 6). Accordingly, when the tape 9 has been cut, the cut tape 9 will not be pinched between the contact surface 36C or the inner surface 36D and the movable blade 41 so that the cut tape 9 can be reliably discharged when discharging the tape 9 by the tape discharge mechanism 22 that will be described later.

Further, by forming the clearance 39, the cut tape 9 will not be pinched as described above, and the distance between the fixed blade 40 or the movable blade 41 and the first guide portion 36 can be made short. It is thus possible to more reliably prevent a case in which a curled tape 9 enters between the fixed blade 40 and the first guide portion 36. Because the distance between the tape cassette 7 and the tape discharge slot 11 can be made short, it will also lead to downsizing of the tape printing apparatus 1.

Figure 11:
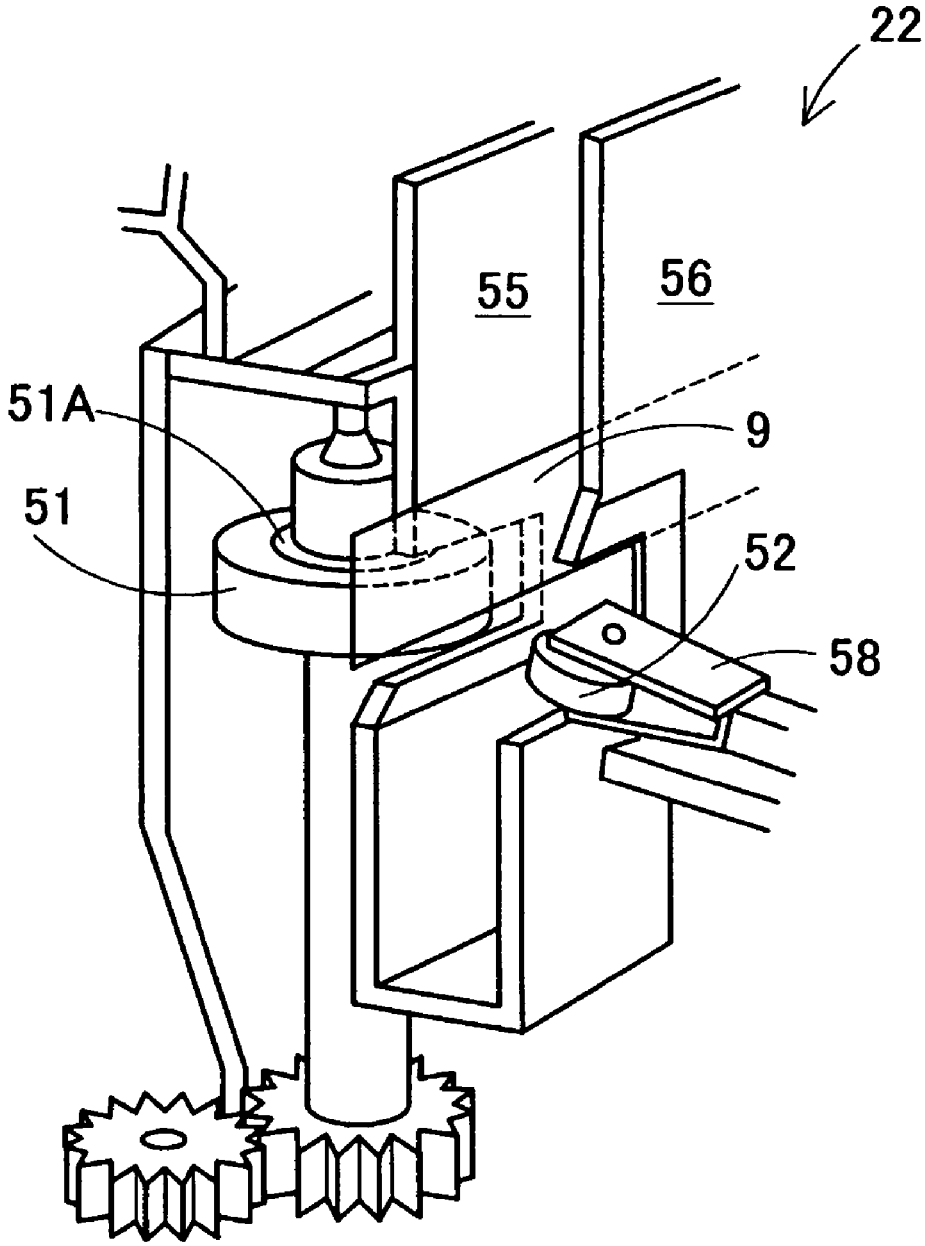
FIG. 11 is a perspective view of a tape discharge mechanism of the tape printing apparatus according to the exemplary embodiment.
Figure 12:
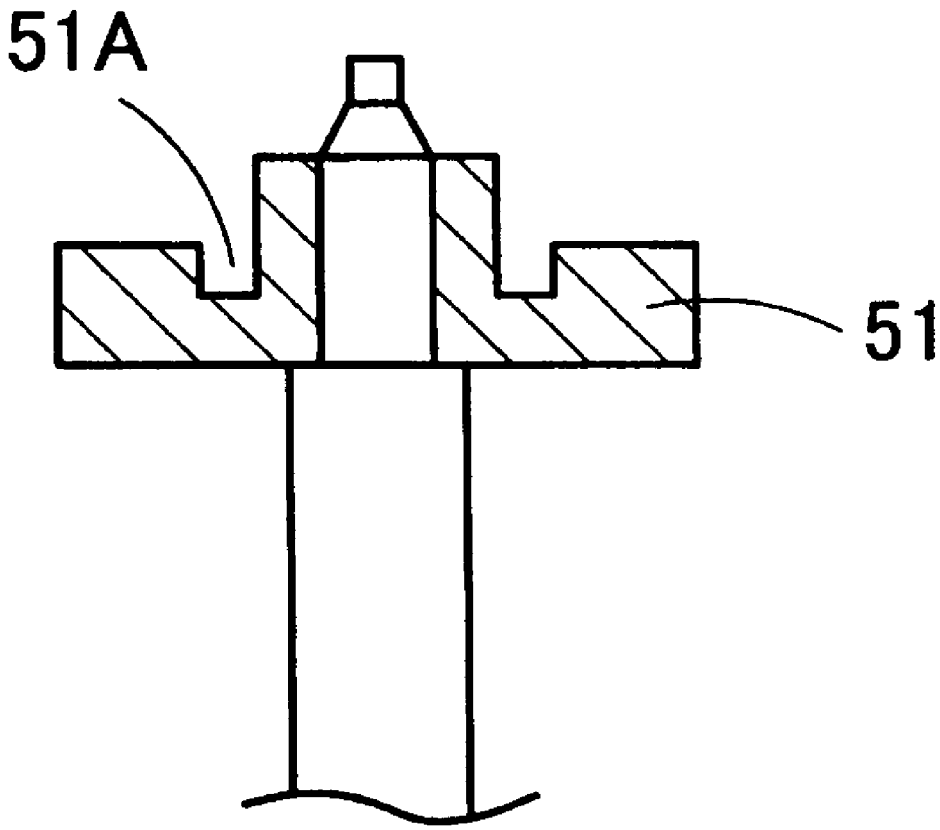
FIG. 12 is a sectional view of a driving roller of the tape printing apparatus according to the exemplary embodiment.

The tape discharge mechanism 22 that forcibly discharges the cut tape 9 will be described with reference to FIG. 2 and FIGS. 11 to 14. FIG. 11 is a perspective view of the tape discharge mechanism 22 according to the invention, FIG. 12 is a sectional view of a driving roller 51, and FIGS. 13A to 13E are explanatory diagrams showing movements of the tape 9 that is discharged by the tape discharge mechanism 22. FIG. 14 is a explanatory diagrams showing movements of the tape that has been discharged through the tape discharge slot.

The tape discharge mechanism 22 is disposed at a proximate location relative to the tape discharge slot 11 provided at the sidewall 10 of the apparatus main body 2. The tape discharge mechanism 22 forcibly discharges the tape 9 through the tape discharge slot 11 after the tape 9 is cut by the cutting mechanism 15.

As shown in FIG. 2, the tape discharge mechanism 22 includes a driving roller 51, a pressing roller 52 that opposes the driving roller 51 to guide the tape 9 in between, a pressing action mechanism portion 53 that is actuated to press the pressing roller 52 against the tape 9 or to release the pressure, and a discharging driving mechanism portion 54 that rotates the driving roller 51 so as to discharge the tape 9 in conjunction with the pressing and releasing action of the pressing action mechanism portion 53.

The first guide walls 55, 56 and second guide walls 63, 64 that guide the tape 9 to the tape discharge slot 11 are provided inside of the tape discharge slot 11 (see FIG. 3). The first guide walls 55, 56 and the second guide walls 63, 64 are uniformly formed with each other and are disposed to be remote from each other by specified intervals at the discharging position of the tape 9 that has been cut by the fixed blade 40 and the movable blade 41. Intermediate portions in vertical directions of the first guide walls 55, 56 have notched portions 55A, 56A that receive the driving roller 51 and the pressing roller 52, respectively. The driving roller 51 is provided at the first guide wall 55 such that the driving roller 51 faces the discharging position of the tape 9 through the notched portion 55A. On the other hand, the pressing roller 52 is supported by the pressing action mechanism portion 53 so as to face the discharging position of the tape 9 through the notched portion 56A at the first guide wall 56.

As shown in FIG. 2, the pressing action mechanism portion 53 includes a roller supporting holder 57, a roller supporting portion 58 that is mounted to the roller supporting holder 57 to hold the pressing roller 52 at a tip end portion, a holder supporting portion 59 that supports the roller supporting holder 57 in a rotatable manner, a cam 60 that drives the pressing action mechanism portion 53 in conjunction with the cutting mechanism 15, and a biasing spring 61.

The roller supporting portion 58 is supported in a rotatable manner so as to pinch the pressing roller 52 from vertical directions. When the roller supporting holder 57 rotates around the holder supporting shaft 59 due to the cam 60 in a counterclockwise direction (direction of arrow 70 in FIG. 2), the cutter helical gear 42 rotates and causes the pressing roller 52 to press against the tape 9. When the cutter helical gear 42 is repeatedly rotated, the holder supporting shaft 59 rotates in an opposite direction due to the biasing spring 61 causing the pressing roller 52 to move away from the tape 9.

The discharging driving mechanism portion 54 includes a tape discharge motor 65 and a gear train 66. When the tape 9 is pressed against the driving roller 51 by the pressing roller 52, the tape discharge motor 65 is driven to rotate the driving roller 51 in the discharging direction of the tape 9 (leftward direction in FIG. 11) to forcibly discharge the tape 9 in the discharging direction.

As shown in FIG. 13A, when the tape 9 is discharged by the tape discharge mechanism 22, a bisectrix 81 of the tape 9 that bisects the width of the tape 9 will be upwardly shifted by a length L2 from a bisectrix 80 of the driving roller 51 that bisects the width of the driving roller 51 and the pressing roller 52.

The pressing roller 52 and the driving roller 51 driven by the tape discharge motor 65 applies a force to the tape 9. By pressing a portion of tape 9 that is located further downward than the bisectrix 81 of the tape 9, the tape 9 is moved in the discharging direction (leftward direction in FIG. 13A).

When the tape 9 is discharged, the tape 9 is discharged in a direction parallel to the driving roller 51 and the pressing roller 52 prior to contact with the driving roller 51 (FIG. 13A) and immediately after discharge of the tape 9 by the driving roller 51 has started (FIG. 13B). Because the bisectrix 81 of the tape 9 is upwardly shifted by L2 from the bisectrix 80 of the driving roller 51 and the pressing roller 52, force will be continuously applied to the portion of the tape 9 that is lower than the bisectrix 81 of the tape 9 so that an upwardly directed force is applied to the tape 9 as the tape 9 is delivered by the driving roller 51. Thus, the cut end of the tape 9 will be gradually directed upward (FIG. 13C). After the tape 9 has passed the driving roller 51, the cut end of the tape 9 will be in an upwardly directed position with respect to the driving roller 51 (FIG. 13D) so that the tape 9 is discharged from the tape discharge slot 11 in a condition in which obliquely upward-directed force is applied thereto (FIG. 13E).

The driving roller 51 includes a roller notched portion 51A that is formed on a top surface thereof as a concentric groove (see FIG. 12). By providing the roller notched portion 51A, it is possible to apply an even more upwardly directed force when the tape 9 is delivered by the driving roller 51. As an upper side of a circumferential surface of the driving roller 51 is more easily flexed toward the center of the driving roller 51 through the roller notched portion 51A than a lower side of the circumferential surface, a force applied on the lower side of the circumferential surface becomes stronger than the force applied on the upper side of the circumferential surface of the driving roller 51 which causes the tape 9 to be delivered upward.

As shown in FIG. 14, the tape 9 is discharged through the tape discharge slot 11 in a condition in which a force has been applied thereto so that the cut end of the tape 9 is facing obliquely upward (direction of arrow 85) whereupon the tape 9 slowly drops to a position in front of the apparatus main body 2. A path of projection of the tape 9 from the main body 2 forms a parabola with a surface of the main body 2 and a drop surface 86. The arrow 85 in FIG. 14 shows the projection of drop of the tape 9. Because the tape 9 drops without being particularly energized from an upward location with respect to a drop surface 86, the discharged tape 9 is not repelled by the drop surface 86 so that the tape 9 is thrown out far away from the apparatus main body 2. It is also possible to prevent a case in which the tape 9 is damaged due to a shock caused by the tape 9 dropping.

With respect to the length L2, when length L2 is too long, the cut end of the tape 9 will rise too far upward so that an opposite effect might occur in which the tape 9 cannot be discharged through the tape discharge slot 11. Surfaces of contact between the tape 9 and the respective rollers 51, 52 may also become so small that no force is actuated in the discharging direction. Thus, the length of L2 is set to be about 2 mm.

When the tape 9 is discharged from the tape discharge mechanism 22, the bisectrix 81 of the tape 9 is arranged to be upwardly shifted by the length L2 from the bisectrix 80 of the driving roller 51 and the pressing roller 52 so that the upper end of the tape 9 is made to abut against the first guide wall 55 after being pressed by the pressing roller 52 as illustrated in FIG. 11. Also, in the case when the width of the tape 9 is small, the entire surface of the tape 9 is not pressed by the pressing roller 52 against the driving roller 51. Therefore, the tape 9 will not enter in between the driving roller 51 and the first guide wall 55 along the driving roller 51, but will be reliably discharged from the tape discharge slot 11.

It is also possible to provide the tape printing apparatus 1 with a tray 90 that receives the tape 9 that has been discharged from the tape discharge mechanism 22. Mounting the tray 90 to the tape printing apparatus 1 will be described with reference to FIGS. 15A to 15C.

As shown in FIG. 15A, the tray 90 is arranged by combining flat plates made of synthetic resin including a bottom surface plate 91, side surface plates 92 integrally formed with the bottom surface plate 91, a front surface plate 93 and a rear surface plate 94. When mounting the tray 90 to the tape printing apparatus 1, the respective flat plates are bent inward with respect to the bottom surface plate 91. Engaging claws 93A are provided at right and left end portions of the front surface plate 93, and engaging holes 95 are provided at the side surface plates 92 at positions corresponding to the engaging claws 93A. By engaging the engaging claws 93A with the engaging holes 95, the side surface plates 92 and the front surface plate 93 are fixed together. A pair of supporting plates 92A is provided at each side surface plate 92 at side end portions on the rear surface plate 94 side. The supporting plates 92A are respectively formed with mounting holes 96 that are formed as rectangles.

As described previously, the sidewall 10 of the tape printing apparatus 1 is provided with the side lid 12. The side lid 12 is opened in a frontward direction by pressing the pressing portion 13 downward (see FIG. 15B). A pair of engaging portions 98 is provided in a protruding manner at an inner wall surface 97 in the interior of the side lid 12. The inner wall surface 97 is revealed after opening the side lid 12.

When mounting the tray 90 to the tape printing apparatus 1, force is first applied to the side surface plates 92 in inward directions (direction of arrow 99) to move the mounting holes 96 inward. Because the side surface plates 92 and the rear surface plate 94 are not fixed with each other, it is possible to easily move the mounting holes 96. Since the engaging portions 98 include protruding portions facing inward as illustrated in FIG. 15B, the respective engaging portions 98 are inserted into the mounting holes 96 that have been biased and moved inward by moving the tray 90 in an inward direction (direction of arrow 100). After releasing the biasing force, the engaging portions 98 will engage with the mounting holes 96 to mount the tray 90 to the apparatus main body 2.

By providing the tray 90 frontward of the tape discharge slot 11 to receive the tapes 9 that has been discharged through the tape discharge mechanism 22, the tapes 9 that have been discharged from the tape discharge slot 11 will be sequentially discharged into the tray 90. The discharged tapes 9 can accordingly be collected in one location within the tray 90, and it is possible to prevent the discharged tapes 9 from getting lost. It will also be easy to collect the discharged tapes 9 after the tapes 9 have been successively printed.

Figure 16:
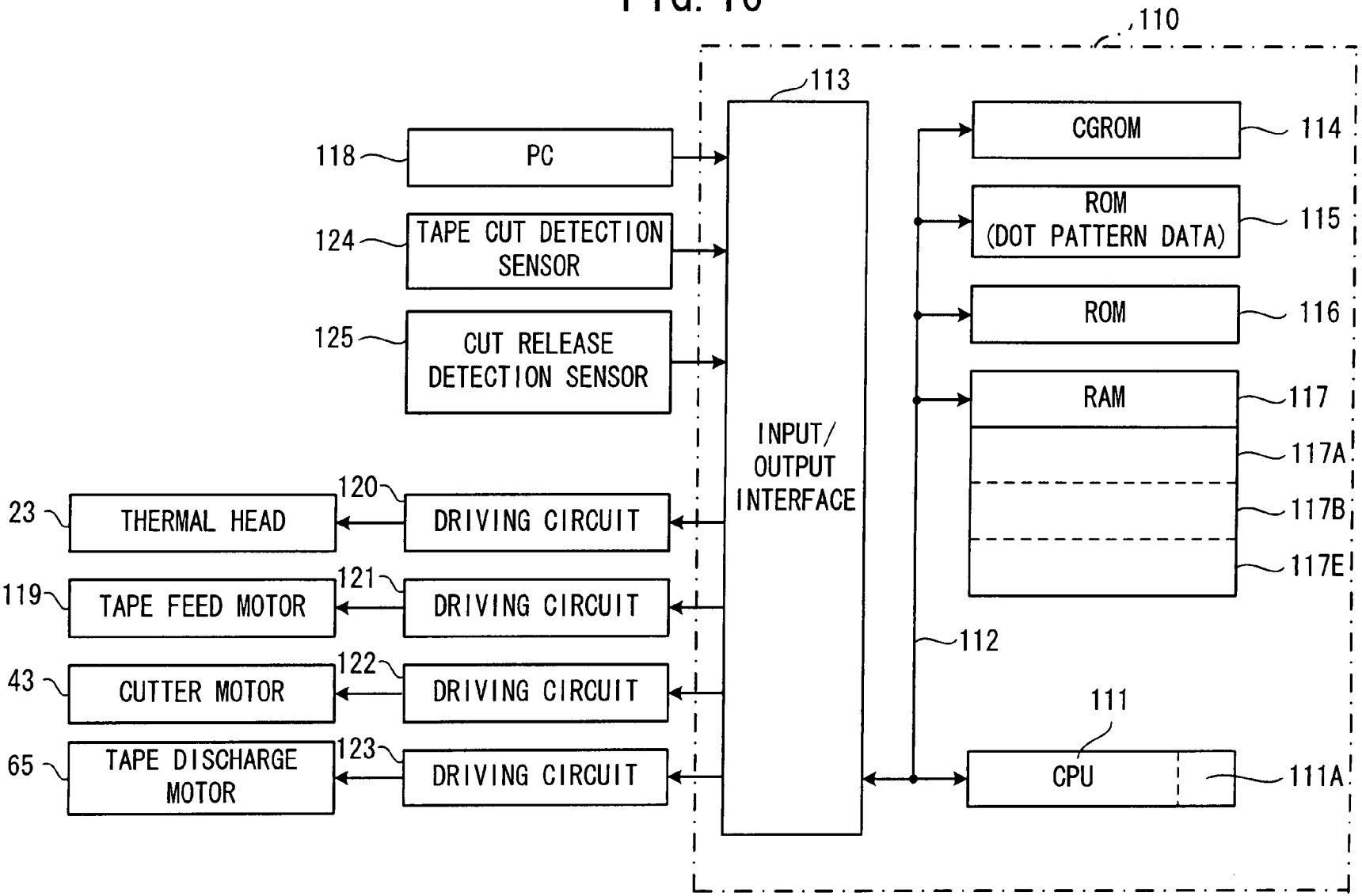
FIG. 16 is a block diagram of the tape printing apparatus according to the exemplary embodiment.

A control system of the tape printing apparatus 1 will be described with reference to FIG. 16. FIG. 16 is a block diagram of the tape printing apparatus 1. A control structure of the tape printing apparatus 1 is arranged with the core being a control circuit portion 110 that is formed on a control substrate (not shown). The control circuit portion 110 includes a CPU 111 that controls respective devices, an input/output interface 113 that is connected to the CPU 111 through a data bus 112, a CGROM 114, ROMs 115, 116, and a RAM 117. Further, a timer 111A is provided inside of the CPU 111.

The CGROM 114 stores therein dot pattern data that display each of a variety of characters in correspondence with code data.

The ROM (dot pattern data memory) 115 stores therein dot pattern data to print each of a large number of characters such as alphabet letters or symbols upon being classified into respective typefaces (gothic type typeface, Mincho typeface etc.) to correspond to code data by types of printing letter sizes for each typeface. Graphic pattern data for printing graphic images including grayscale expressions are also stored.

The ROM 116 stores therein a printing driving control program that drives the thermal head 23, a tape feed motor 119 or the tape discharge motor 65 upon reading data of a print buffer to correspond to code data of characters such as letters or numerals input from a PC 118, a pulse number determining program that determines numbers of pulses that correspond to the respective energy amounts of forming printed dots, a cutting driving control program that drives the tape feed motor 119 such that the tape 9 is delivered to the cutting position and that drives the cutter motor 43 for cutting the tape 9 upon completion of printing (see FIG. 19), a tape discharge program that forcibly discharges the cut tape 9 through the tape discharge slot 11 by driving the tape discharge motor 65 (see FIG. 19) and other various programs necessary for controlling the tape printing apparatus 1. The CPU 111 performs various calculations on the basis of the various programs that are stored in the ROM 116.

The RAM 117 is provided, among others, with a text memory 117A, a print buffer 117B, and a parameter storing area 117E. The text memory 117A stores document data that have been input from a PC 118. The print buffer 117B stores therein, among others, a plurality of dot patterns that print characters such as letters, symbols or impressed number of pulses that represent energy amounts that form the dots as dot pattern data. The thermal head 23 performs dot printing in accordance with the dot pattern data that are stored in the print buffer 117B. The parameter storing area 117E stores therein various calculation data.

The PC 118, a driving circuit 120 that drives the thermal head 23, a driving circuit 121 that drives the tape feed motor 119, a driving circuit 122 that drives the cutter motor 43, a driving circuit 123 that drives the tape discharge motor 65, a tape cut direction sensor 124 and a cut release detection sensor 125 are respectively connected to the input/output interface 113.

Upon input of letter data or the like through the PC 118, the texts (document data) are sequentially stored in the text memory 117A as the thermal head 23 is driven by the driving circuit 120 to print dot pattern data stored in the print buffer 117B, and the tape feed motor 119 performs delivery control of the tape 9 synchronously therewith through the driving circuit 121. Here, the thermal head 23 performs printing of characters, letters or the like onto tapes 9 by selectively heating and driving the respective heating elements in correspondence with printing dots representing a single line through the driving circuit 120.

The tape cut detection sensor 124 and the cut release detection sensor 125 include the cutter helical gear cam 42A and the micro switch 126 that are provided on the cylindrical outer wall of the cutter helical gear 42 (see FIGS. 7 and 8). More particularly, when the cutter helical gear 42 is rotated by the cutter motor 43, the micro switch 126 will be switched from OFF to ON through the action of the cutter helical gear cam 42A, and the tape cut detection sensor 124 detects that cutting of the tape 9 by the movable blade 45 has been completed. When the cutter helical gear 42 is further rotated, the micro switch 126 will be switched from ON to OFF through the action of the cutter helical gear cam 42A, and the cut release detection sensor 125 detects that the movable blade 45 has returned to the releasing position.

Figure 17:
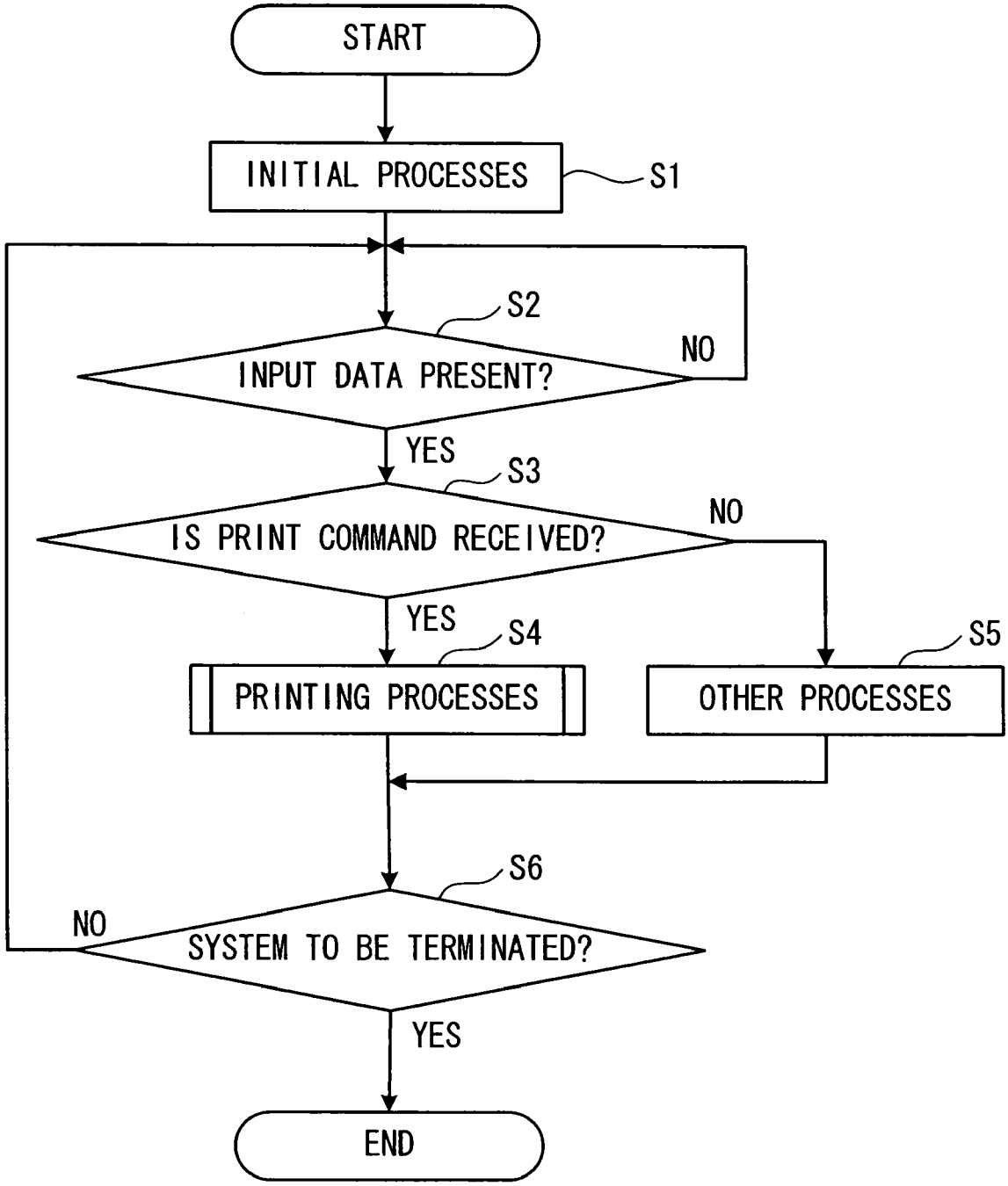
FIG. 17 is a flowchart of a main system control program of the tape printing apparatus according to the exemplary embodiment.
Figure 18:
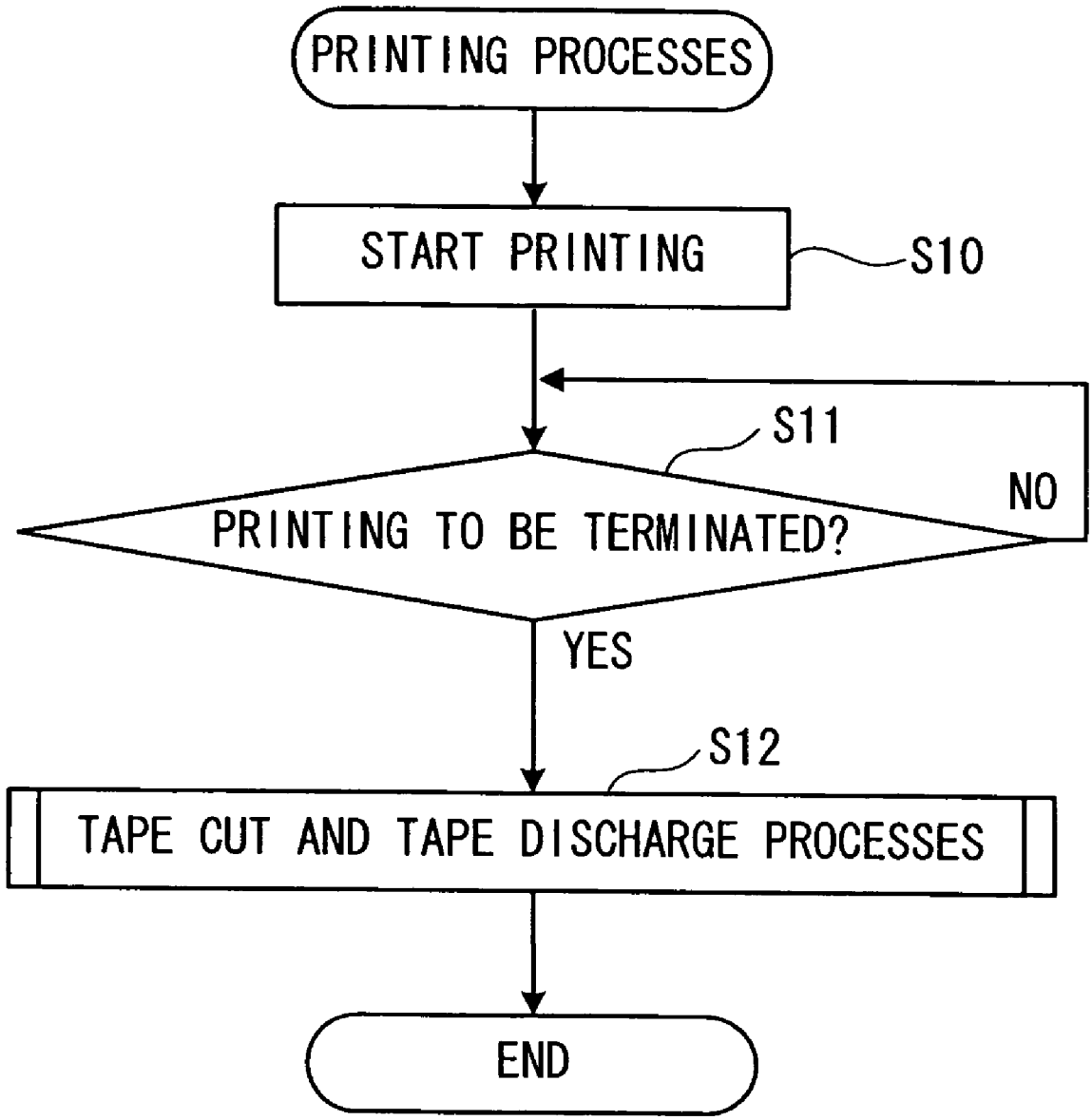
FIG. 18 is a flowchart of a print control program of the tape printing apparatus according to the exemplary embodiment.
Figure 19:
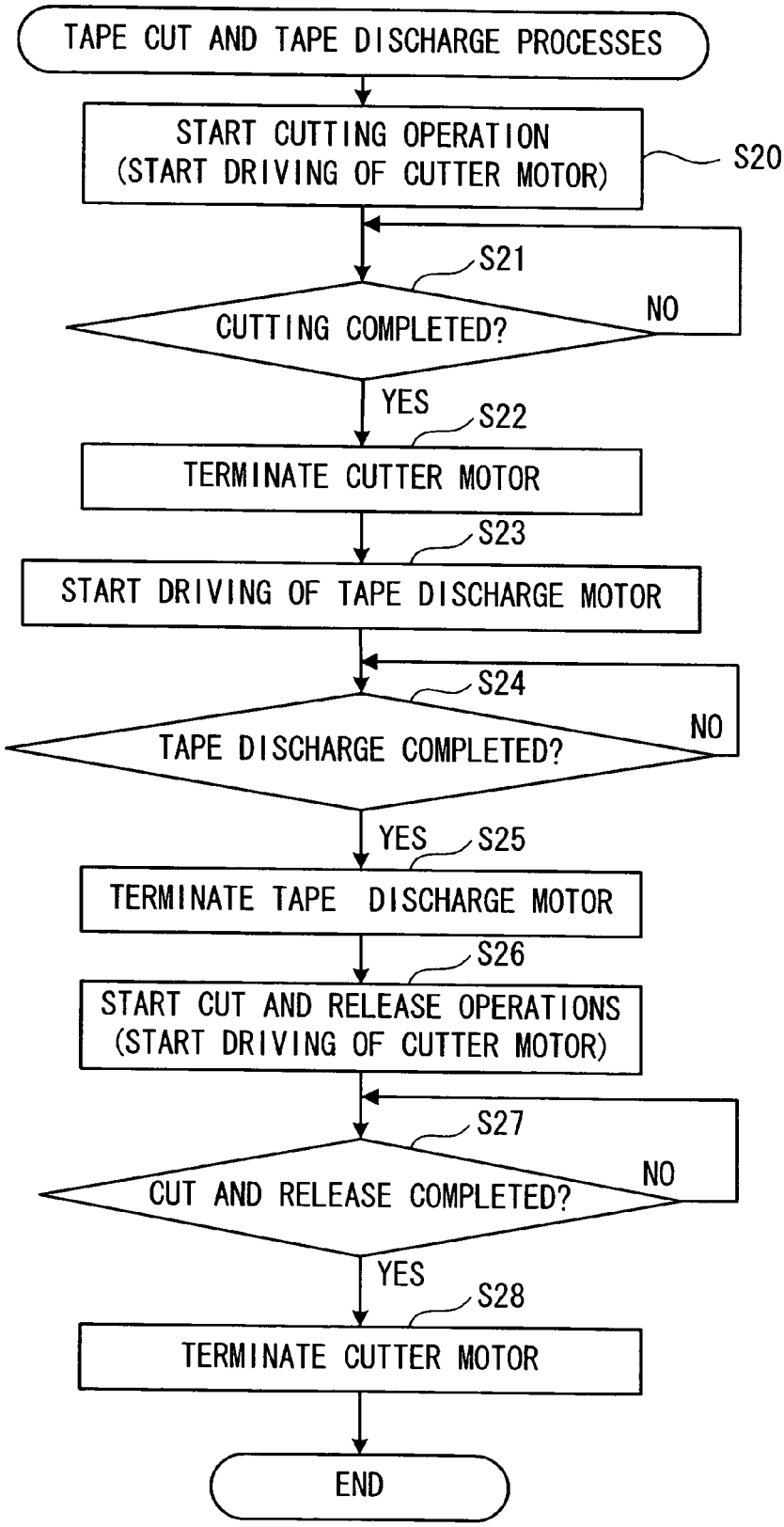
FIG. 19 is a flowchart of a cutting driving control program and a tape discharge program of the tape printing apparatus according to the exemplary embodiment.

Operations of the tape printing apparatus 1 of the above-described structure will be described with reference to FIGS. 17 to 19. FIG. 17 is a flowchart of a main system control program of the tape printing apparatus 1.

In step S1, initialization processes of the control program such as clearing of respective memories is performed.

In step S2, it is determined whether a data input has been made through the PC 118. When no data input has been made (S2: NO), the program repeatedly proceeds to step S2 and awaits input data. When a data input has been made (S2: YES), the program proceeds to step S3.

In step S3, it is determined whether printing is to be performed on the basis of the input data. When printing is to be performed (S3: YES), printing processes (S4) are performed. When no printing is to be performed (S3: NO), other processes corresponding to the pressed key are performed (S5) whereupon the program proceeds to step S6. When the system is to be terminated (S6: YES), the program is terminated and when the system is to be continuously used (S6: NO), the program jumps back to step S2.

The printing processes of step S4 will be described with reference to FIG. 18. FIG. 18 is a flowchart of a printing control program.

In step S10, printing is started. In step S11, it is determined whether printing has been completed or not. When printing has not been terminated (S11: NO), the program repeatedly proceeds to step S11 to continue printing. On the other hand, when printing has been terminated (S11: YES), the program proceeds to step S12.

In step S12, tape cut and tape discharge processes are performed. Then, the printing processes are terminated.

The tape cut and tape discharge processes of step S12 will be described with reference to FIG. 19. FIG. 19 is a flowchart of the cutting driving control and tape discharge program. The cutting mechanism 15 and the tape discharge mechanism 22 are arranged so that they are operated in conjunction with each other.

In step S20, when cutting operations are started by the cutting mechanism 15, the cutter motor 43 is driven to rotate the cutter helical gear 42 in the counterclockwise direction (direction of arrow 70 in FIG. 2), and the roller supporting holder 57 is rotated about the holder supporting portion 59 in the counterclockwise direction (direction of arrow 71 in FIG. 2) by the boss 50 and the cam 60. The tape 9 is pressed against the driving roller 51 by the pressing roller 52 immediately before the tape 9 starts to be cut by the fixed blade 40 and the movable blade 41 and the tape 9 is held until the tape 9 has been cut. Then, the program proceeds to step S21.

In step S21, it is determined by the tape cut detection sensor 124 whether cutting of the tape 9 has been completed or not. When the micro switch 126 is switched from OFF to ON and it has been determined that cutting has been completed (S21: YES), rotation of the cutter motor 43 is temporally terminated in step S22, and the program immediately proceeds to step S23. When cutting has not been completed yet (S21: NO), cutting is performed. More particularly, driving of the cutter motor 43 is continued until the micro switch 126 is switched from OFF to ON.

When the cutter motor 43 is terminated upon completion of cutting, the tape discharge motor 65 starts rotating, and the driving roller 51 is rotated through the gear train 66 for discharging the tape 9 that had been held (S23). It is then determined in step S24 whether the tape 9 has been discharged or not. When the tape 9 has been discharged (S24: YES), rotation of the tape discharge motor 65 is terminated (S25) and the program immediately proceeds to step S26. When discharge has not been completed yet (S24: NO), discharge is awaited. In this respect, whether the tape 9 has been discharged or not is determined on the basis of an elapse of time from the start of discharge (0.5 sec to 1.0 sec in the exemplary embodiment).

In step S26, the cutter motor 43 is again rotated. In this manner, the cutter helical gear 42 is repeatedly rotated to rotate and return the movable blade 41 to the releasing position (see FIG. 6) as the roller supporting holder 57 is rotated in a direction in which the pressing roller 52 separates from the driving roller 51 by a force of the biasing spring 61 (direction of arrow 71 in FIG. 2) and is maintained by a stopper 72 at a specified interval. In step S27, it is determined by the cut release detection sensor 125 whether the cut and release operations have been completed. When the micro switch 126 has not been switched from ON to OFF yet and the cut and release operations have not been completed (S27: NO), rotation of the cutter motor 43 is continued until the cut and release operations are completed. When the micro switch 126 has been switched from ON to OFF and the cut and release operations have been completed (S27: YES), rotation of the cutter motor 43 is terminated (S28) and the tape cut and tape discharge processes are completed.

The invention is not limited to the illustrated embodiments. Various improvements, combinations and configurations can be made without departing from the scope of the invention.

Figure 20:
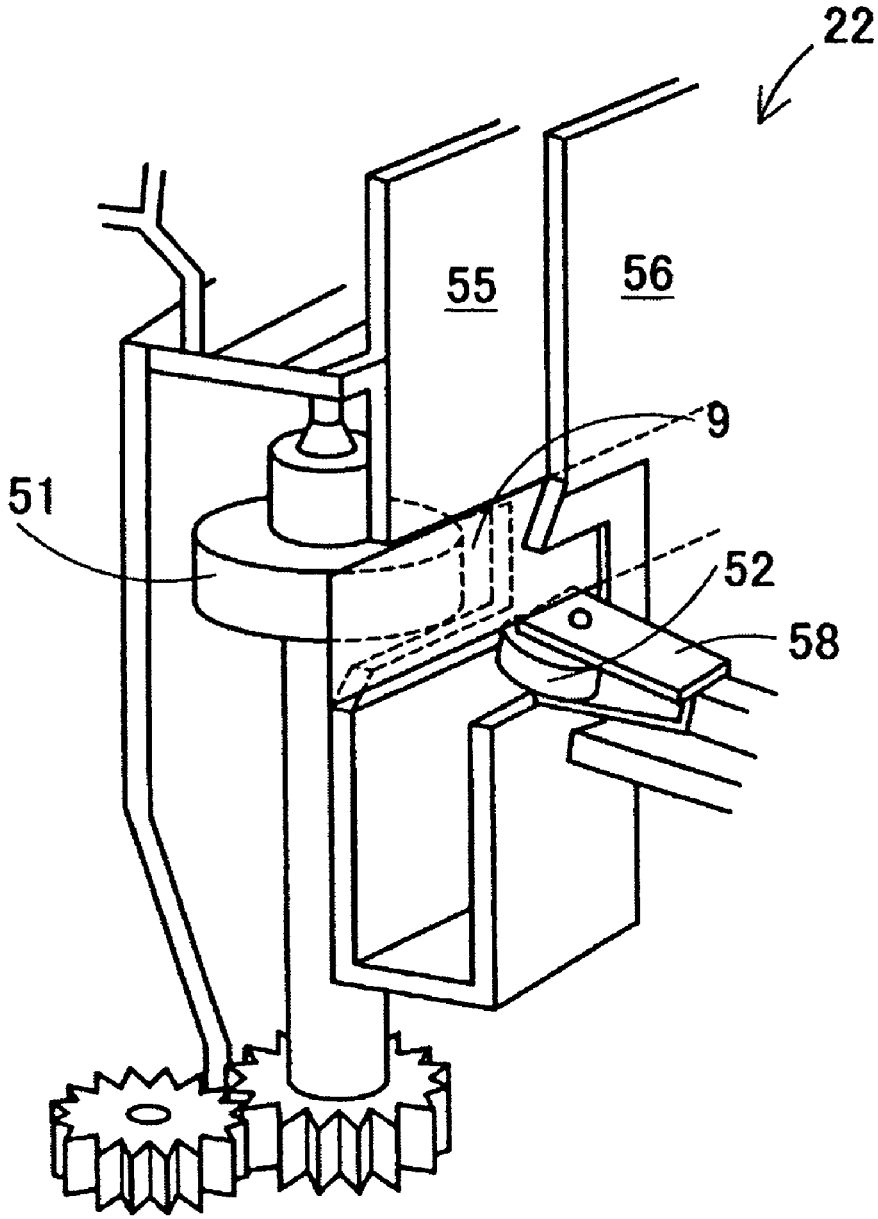
FIG. 20 is a perspective view of a tape discharge mechanism of the tape printing apparatus according to another exemplary embodiment of the invention.

For example, as the bisectrix 81 of the tape 9 has been located upward of the driving roller 51 and the pressing roller 52 in the exemplary embodiment, it is possible to locate the bisectrix 81 of the tape 9 further downward of the bisectrix 80 of the driving roller 51 and the pressing roller 52 as an alternative embodiment (see FIG. 20).

Figure 21:
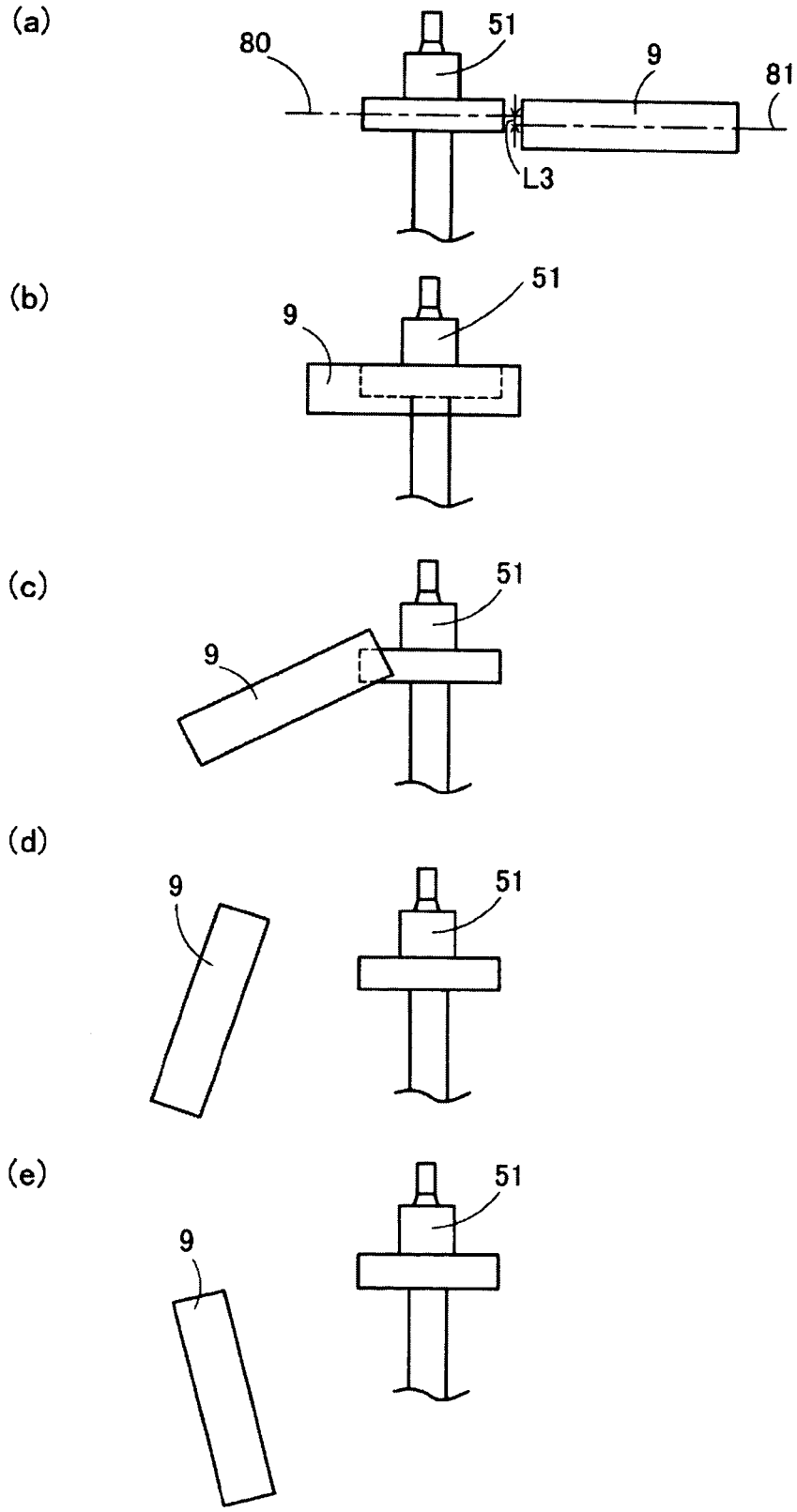
FIG. 21*a* is an explanatory diagram illustrating movements of the tape before the tape is delivered by the driving roller of the tape printing apparatus of FIG. 20.
FIG. 21*b* is an explanatory diagram illustrating movements of the tape immediately after delivery by the driving roller of FIG. 21*a;*
FIG. 21*c* is an explanatory diagram illustrating movements of the tape during delivery by the driving roller of FIG. 21*a;*
FIG. 21*d* is an explanatory diagram illustrating movements of the tape after delivery by the driving roller of FIG. 21*a;*
FIG. 21*e* is an explanatory diagram illustrating movements of the tape after delivery by the driving roller of FIG. 21*a* and after discharge thereof.
Figure 22:
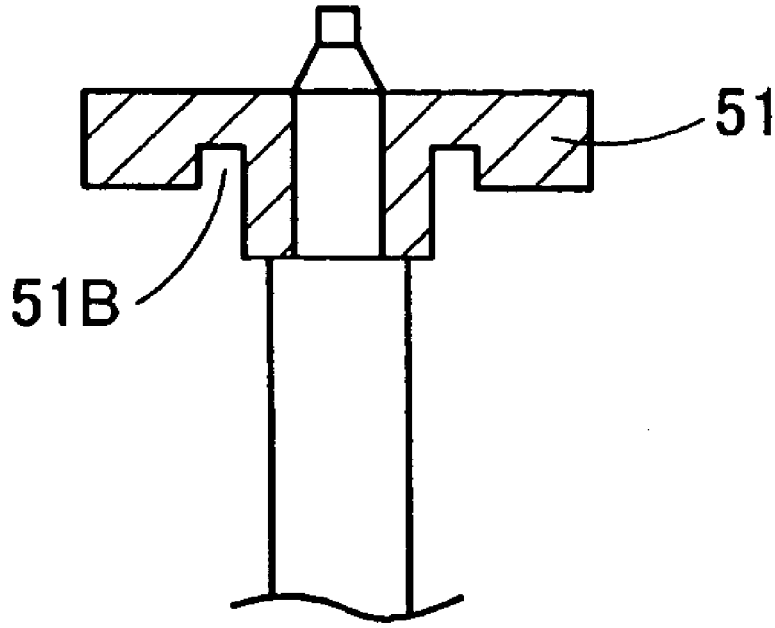
FIG. 22 is a sectional view of a driving roller of the tape printing apparatus according to another exemplary embodiment.

As illustrated in FIG. 21A, when the tape 9 is discharged by the tape discharge mechanism 22, the bisectrix 81 of the tape 9 is arranged in a position downwardly shifted by a length L3 from the bisectrix 80 of the driving roller 51 and the pressing roller 52. As shown in FIG. 22, in this exemplary embodiment, a roller notched portion 51B is provided on a lower surface of the driving roller 51 as a concentric groove so as to apply a downwardly directed force when the tape 9 is delivered by the driving roller 51.

Accordingly, when the tape 9 is discharged, the tape 9 is discharged to be parallel to the driving roller 51 and the pressing roller 52 prior to contact with the driving roller 51 (FIG. 21A) and immediately after discharge by the driving roller 51 has started (FIG. 21B). Because force will be continuously applied to a portion of the tape 9 that is located upwards from the bisectrix 81 of the tape 9, a downwardly directed force is applied to the tape 9 as the tape 9 is being delivered by the driving roller 51 so that the cut end of the tape 9 is gradually directed downward (FIG. 21C). After the tape 9 has passed the driving roller 51, the cut end of the tape 9 will be positioned in a downwardly directed condition with respect to the driving roller 51 (FIG. 21D) so that the tape 9 is rotated in a downward direction and is discharged from the tape discharge slot 11 in a condition in which the tape 9 faces obliquely downward (FIG. 21E).

Accordingly, the tape 9 will be discharged outside of the tape printing apparatus 1 in a downwardly rotated position. Although effects will be somewhat reduced when compared to the above-described case in which the tape 9 is discharged upwardly, the same effects can be expected when a certain degree of distance or more from the tape discharge slot 11 to the drop surface 86 has been secured. More particularly, it is possible to drop and discharge the tape 9 from the tape discharge slot 11 at a suitable speed to a proximate location relative to the tape printing apparatus 1. Because the cut tape 9 will not be thrown far away from the tape discharge slot 11, it is possible to prevent the tape 9 from getting lost and to reliably perform discharge without damaging the tape 9 through shock on the tape 9 caused by the tape 9 dropping.

Figure 13:
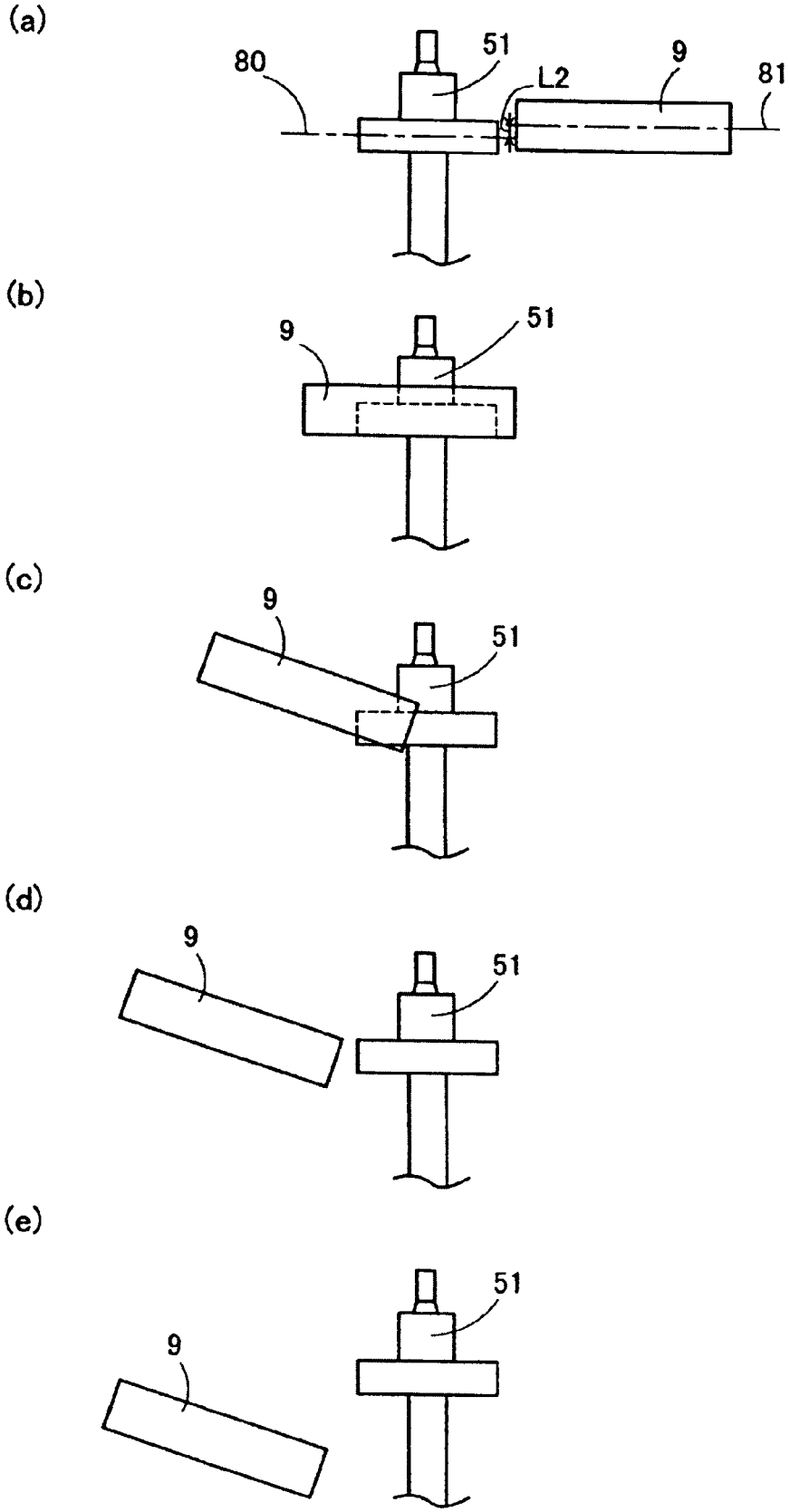
FIG. 13*a* is an explanatory diagram illustrating movements of a tape before the tape is delivered by the driving roller of FIG. 12.
FIG. 13*b* is an explanatory diagram illustrating movements of a tape immediately after delivery by the driving roller of FIG. 12.
FIG. 13*c* is an explanatory diagram illustrating movements of the tape during delivery by the driving roller of FIG. 12
FIG. 13*d* is an explanatory diagram illustrating movements of the tape after the delivery of FIG. 13*b;*
FIG. 13*e* is an explanatory diagram illustrating movements of the tape after delivery by the driving roller and after discharge thereof.
Figure 14:
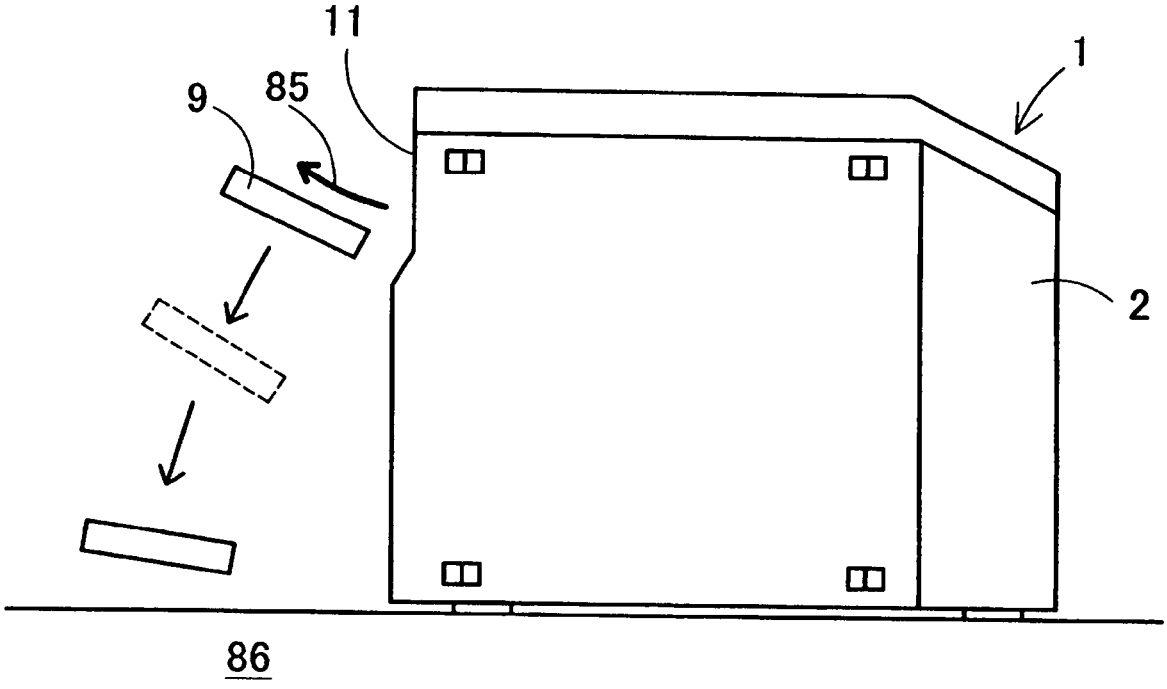
FIG. 14 is an explanatory diagram illustrating movements of the tape after discharge from a tape discharge slot.

The operation of the tape printing apparatus 1 according to the exemplary embodiment shown in FIG. 13 is described below. When printing the tape 9 stored in the tape cassette 7 by the thermal head 23, cutting the tape 9 by the fixed blade 40 and the movable blade 41 and forcibly discharging the tape 9 by the driving roller 51 and the pressing roller 52, the bisectrix 81 that bisects the width of the tape 9 in vertical direction is located further upward than the bisectrix 80 of the driving roller 51 and the pressing roller 52 by the length L2. The cut end of the tape 9 will be gradually directed upward in the course of delivery of the tape 9 by the driving roller 51 and the pressing roller 52 so that the tape 9 will be discharged outside of the tape printing apparatus 1 through the tape discharge slot 11 in a obliquely maintained position whereby the tape 9 is discharged obliquely upward and then slowly drops frontward of the apparatus main body 2. The projectile of the discharged tape 9 forms a parabola with a surface of the main body 2 and the drop surface 86. Because the tape 9 drops slowly from a determined height upward with respect to the drop surface 86, the discharged tape 9 is not greatly repelled by the drop surface 86 and thrown far away from the apparatus main body 2. It is also possible to prevent a case in which the tape 9 is damaged on by the shock on the tape 9 caused by the tape 9 dropping.

Additionally, because the driving roller 51 is driven by the tape discharge motor 65, it is possible to adjust the rotating speed of the driving roller 51 so that the tape 9 may be discharged from the tape discharge slot 11 at a suitable speed. Accordingly, the tape 9 will not be discharged in an excessively accelerated condition causing the tape 9 to be thrown far away from the apparatus main body 2 and to get lost.

Further, by providing the tray 90 at the front surface of the tape discharge slot 11, the tapes 9 that have been discharged from the tape discharge slot 11 will be sequentially discharged into the tray 90. Accordingly, the discharged tapes 9 can be collected at one location within the tray 90. Thus, it is possible to prevent the discharged tapes 9 from getting lost.

As described with reference to FIG. 6., the end portion 36B of the first guide portion 36 that opposes the tape 9 being discharged is arranged to project along the anvil 38B formed at the end portion of the fixed arm 38, to be bent in a discharging direction of the tape 9 and to include a smooth curved surface with respect to the discharging direction of the tape 9 at the contact surface 36C. The cut end of the tape 9 is curled by not less than a specified curvature. The cut end of the tape 9 will first abut the end portion 36B of the first guide portion 36. At this time, when the cut end of the tape 9 hits a portion of the first guide portion 36 that is located closer to the discharging direction of the tape 9 than the boundary point 75 on the contact surface 36C of the first guide portion, the cut end of the tape 9 will move downward along the curved surface so that the tape 9 will not enter a space between the fixed blade 40 and the first guide portion 36. Instead, the cut end of the tape 9 may be introduced in the direction of the tape discharge slot 11. Accordingly, it is possible to reliably discharge the tape 9 from the tape discharge slot 11 without the tape 9 remaining in the interior of the apparatus main body 2. It is further possible to prevent a case, when tapes 9 are successively discharged, in which the tape 9 remaining in the apparatus main body 2 clogs the tape discharge slot 11 whereupon the following tapes 9 are jammed in the tape discharge slot 11.

Because the blade part 45 of the movable blade 41 is formed by a two-stepped blade, when the tape 9 is cut by the movable blade 41, a clearance 39 will be formed between the contact surface 36C that corresponds to the end portion of the first guide portion 36 or the inner surface 36D and the second sloped surface 45B of the movable blade 41. When the tape 9 has been cut, the cut tape 9 will not be pinched between the contact surface 36C or the inner surface 36D and the movable blade 41 so that the cut tape 9 can be reliably discharged by the tape discharge mechanism 22. Further, by forming the clearance 39, the cut tape 9 will not be pinched as described above, and the distance between the fixed blade 40 or the movable blade 41 and the first guide portion 36 can be made short. Thus, it is possible to more reliably prevent a case in which a curled tape 9 enters between the fixed blade 40 and the first guide portion 36. Since the distance between the tape cassette 7 and the tape discharge slot 11 can be made short, it will also lead to a downsizing of the tape printing apparatus 1.

As the invention has been described with reference to exemplary embodiments, it is to be understood that the invention is not limited to the exemplary embodiments or constructions. As the various elements of the exemplary embodiments are shown in various combinations and configurations, which are exemplary, other combinations and configurations, including more, less or only a single element, are also within the spirit and scope of the invention.

What is claimed is:

1. A tape printing apparatus, comprising:

an apparatus main body having a topmost wall and a bottommost wall;

a cassette accommodating section that accommodates a tape cassette having a tape therein, the cassette accommodating section located within the apparatus main body;

a print head that performs printing on the tape drawn out from the tape cassette;

a cutter that cuts the tape printed by the print head;

a tape discharge slot through which the tape cut by the cutter is discharged; and a discharge roller that discharges the tape cut by the cutter through the tape discharge slot, wherein a bisectrix that bisects a width of the tape and a bisectrix that bisects a roller width of the discharge roller are disposed so that the bisectrix of the discharge roller is located closer to a bottommost surface of the cassette accommodating section than a bisectrix of the tape.

2. The tape printing apparatus according to claim 1, wherein the cassette accommodating section accommodates the cassette such that a width direction of the tape is disposed in a vertical direction and the bisectrix of the tape is disposed closer to the topmost wall than the bisectrix of the discharge roller.

3. The tape printing apparatus according to claim 2, wherein the discharge roller is formed with a concentric groove on an upper surface thereof.

4. The tape printing apparatus according to claim 3, further comprising a discharge motor which drives the discharge roller.

5. The tape printing apparatus according to claim 4, further comprising a tray portion, that receives the tape that has been discharged from the tape discharge slot, provided externally of the apparatus main body and frontward of the tape discharge slot.

6. The tape printing apparatus according to claim 1, wherein the discharge roller is formed with a concentric groove on a lower surface thereof.

7. The tape printing apparatus according to claim 1, further comprising a discharge motor which drives the discharge roller.

8. The tape printing apparatus according to claim 7, further comprising a tray portion, that receives the tape that has been discharged from the tape discharge slot, provided externally of the apparatus main body and frontward of the tape discharge slot.

9. The tape printing apparatus according to claim 1, further comprising a concentric groove formed on one of an upper surface and a lower surface of the discharge roller that is closer to the bisectrix of the tape.

10. The tape printing apparatus according to claim 1, further comprising a discharge motor which drives the discharge roller.

11. The tape printing apparatus according to claim 1, further comprising a tray portion, that receives the tape that has been discharged from the tape discharge slot, provided externally of the apparatus main body and frontward of the tape discharge slot.

12. A method of discharging a tape in a tape printing apparatus having an apparatus main body including a topmost wall and a bottommost wall, comprising:

accommodating a tape cassette having a tape therein in a cassette accommodating section;

printing, by a print head, on the tape that has been drawn out from the tape cassette;

cutting the tape that has been printed by the print head using a cutter;

discharging the tape that has been cut through a tape discharge slot; and discharging the tape that has been cut by the cutter through the tape discharge slot using a discharge roller, wherein discharging the tape by using the discharge roller includes disposing a bisectrix that bisects a width of the tape and a bisectrix that bisects a roller width of the discharge roller so that the bisectrix of the discharge roller is located closer to a bottommost surface of the cassette accommodating section than a bisectrix of the tape.

13. The method according to claim 12, wherein accommodating the tape cassette in the cassette accommodating section includes disposing a width direction of the tape in a vertical direction and disposing the bisectrix of the tape closer to the topmost wall than the bisectrix of the discharge roller.

14. The method according to claim 13, wherein using the discharge roller includes using the discharge roller formed with a concentric groove on an upper surface thereof.

15. The method according to claim 14, further comprising driving the discharge roller using a discharge motor.

16. The method according to claim 15, further comprising providing, externally of the apparatus main body and frontward of the tape discharge slot, a tray portion receiving the tape that has been discharged from the tape discharge slot.

17. The method according to claim 13, wherein using the discharge roller includes using the discharge roller formed with a concentric groove on a lower surface thereof.

18. The method according to claim 13, further comprising driving the discharge roller using a discharge motor.

19. The method according to claim 18, further comprising providing, externally of the apparatus main body and frontward of the tape discharge slot, a tray portion receiving the tape that has been discharged from the tape discharge slot.

20. The method according to claim 12, wherein using the discharge roller includes using a discharge roller formed with a concentric groove on one of an upper surface and a lower surface of the discharge roller that is closer to the bisectrix of the tape.

21. The method according to claim 12, further comprising driving the discharge roller using a discharge motor.

22. The method according to claim 12, further comprising providing, externally of the apparatus main body and frontward of the tape discharge slot, a tray portion receiving the tape that has been discharged from the tape discharge slot.

* * * * *